US007805908B2

(12) United States Patent
Rutledge

(10) Patent No.: US 7,805,908 B2
(45) Date of Patent: Oct. 5, 2010

(54) LOAD-BEARING SYSTEM FOR FILL MATERIAL STRUCTURE FORMATION

(75) Inventor: M. Douglas Rutledge, Loveland, CO (US)

(73) Assignee: CorTek, Inc., Berthoud, CO (US)

( * ) Notice: Subject to any disclaimer, the term of this patent is extended or adjusted under 35 U.S.C. 154(b) by 896 days.

(21) Appl. No.: 11/115,017

(22) Filed: Apr. 25, 2005

(65) Prior Publication Data

US 2005/0193678 A1 Sep. 8, 2005

(51) Int. Cl.

| | |
|---|---|
| ***E04B 1/00*** | (2006.01) |
| ***E04B 1/16*** | (2006.01) |
| ***E04G 21/00*** | (2006.01) |
| ***E04G 23/00*** | (2006.01) |
| ***E04C 2/42*** | (2006.01) |

(52) U.S. Cl. ..... 52/742.14; 52/742.1; 52/742.13; 52/745.03; 52/337; 52/660

(58) Field of Classification Search ..... 52/79.1–79.3, 52/742.1, 742.14, 425, 428, 745.01–745.03, 52/337, 652.1, 660, 724.3, DIG. 2, 234–235, 52/309.12, 378, 704–711, 741.2, 742.13, 52/745.19, 745.2

See application file for complete search history.

(56) References Cited

U.S. PATENT DOCUMENTS

| | | | | | |
|---|---|---|---|---|---|
| 1,879,319 | A | * | 9/1932 | Kleitz | 52/378 |
| 3,383,817 | A | * | 5/1968 | Gregorl | 52/309.11 |
| 3,530,632 | A | * | 9/1970 | Sloan | 52/425 |
| 3,552,076 | A | * | 1/1971 | Gregori | 52/309.12 |
| 3,768,225 | A | * | 10/1973 | Sloan | 52/742.14 |
| 3,945,157 | A | | 3/1976 | Borys | |
| 3,990,193 | A | * | 11/1976 | Ray et al. | 52/79.11 |
| 4,050,203 | A | * | 9/1977 | Souza, Jr. | 52/185 |
| 4,088,361 | A | * | 5/1978 | Ditcher | 294/89 |
| 4,107,886 | A | * | 8/1978 | Ray et al. | 52/79.11 |
| 4,306,391 | A | | 12/1981 | Crosby | |
| 4,398,378 | A | | 8/1983 | Heitzman | |
| 4,513,545 | A | | 4/1985 | Hopkins, Jr. | |
| 4,545,159 | A | * | 10/1985 | Rizk | 52/79.9 |
| 4,546,530 | A | * | 10/1985 | Rizk | 29/430 |
| 4,604,838 | A | * | 8/1986 | Remington et al. | 52/73 |
| 4,620,404 | A | | 11/1986 | Rizk | |
| 4,644,709 | A | | 2/1987 | Baumann | |
| 4,669,240 | A | * | 6/1987 | Amormino | 52/236.6 |
| 4,679,366 | A | | 7/1987 | Hitchins | |
| 4,717,517 | A | | 1/1988 | Halberstadt | |
| 4,731,971 | A | * | 3/1988 | Terkl | 52/742.14 |
| 4,785,602 | A | * | 11/1988 | Giurlani | 52/309.12 |
| 4,807,407 | A | * | 2/1989 | Horn | 52/79.1 |
| 4,860,515 | A | * | 8/1989 | Browning, Jr. | 52/426 |
| 4,864,792 | A | * | 9/1989 | Andre et al. | 52/426 |
| 4,879,855 | A | * | 11/1989 | Berrenberg | 52/309.11 |
| 4,901,494 | A | * | 2/1990 | Miller et al. | 52/309.12 |
| 4,918,897 | A | * | 4/1990 | Luedtke | 52/742.14 |
| 4,924,641 | A | * | 5/1990 | Gibbar, Jr. | 52/204.1 |

(Continued)

*Primary Examiner*—Richard E Chilcot, Jr.
*Assistant Examiner*—Andrew J Triggs
(74) *Attorney, Agent, or Firm*—Santangelo Law Offices, P.C.

(57) ABSTRACT

Methods and apparatus for the formation of structures utilizing fill materials capable of hardening, such as concrete. The methods and apparatus may include the employment of enhanced load-bearing capabilities, which may yield substantial efficiencies in time, labor, materials and costs attendant to fill material formation. The methods and apparatus may be particularly suited for use with manufacturing and prefabrication processes.

63 Claims, 20 Drawing Sheets

U.S. PATENT DOCUMENTS 4,972,646 A * 11/1990 Miller et al. ..... 52/293.1
4,998,393 A * 3/1991 Baena ..... 52/236.9
5,024,035 A * 6/1991 Hanson et al. ..... 52/591.1
5,038,541 A * 8/1991 Gibbar, Jr. ..... 52/295
5,040,344 A * 8/1991 Durand ..... 52/127.2
5,074,088 A * 12/1991 Bergeron et al. ..... 52/309.12
5,081,805 A 1/1992 Jazzar
5,127,201 A 7/1992 Skvaril
5,129,203 A * 7/1992 Romero ..... 52/309.11
5,163,263 A * 11/1992 DeSchutter et al. ..... 52/742.14
5,203,128 A * 4/1993 Bennett ..... 52/189
5,279,091 A 1/1994 Williams et al.
5,528,876 A * 6/1996 Lu ..... 52/654.1
5,657,606 A 8/1997 Ressel et al.
5,761,873 A 6/1998 Slater
6,041,561 A * 3/2000 LeBlang ..... 52/234
6,067,771 A * 5/2000 Blankenship ..... 52/745.2
6,101,779 A 8/2000 Davenport
6,226,942 B1 * 5/2001 Bonin ..... 52/309.12
6,247,280 B1 * 6/2001 Grinshpun et al. ..... 52/309.12
6,260,322 B1 7/2001 Lindsay
6,272,805 B1 * 8/2001 Ritter et al. ..... 52/309.11
6,276,104 B1 * 8/2001 Long et al. ..... 52/309.4
6,279,285 B1 * 8/2001 Kubica ..... 52/426
6,314,696 B2 * 11/2001 Fust, III ..... 52/422
6,321,498 B1 * 11/2001 Trovato ..... 52/426
6,397,529 B1 6/2002 Grenier
6,401,417 B1 * 6/2002 Leblang ..... 52/481.1
6,405,505 B1 * 6/2002 Alberti ..... 52/562
6,443,418 B1 * 9/2002 Itamochi ..... 249/34
6,467,234 B1 10/2002 Marshall
6,581,352 B1 6/2003 Amirsoleymani
6,622,452 B2 * 9/2003 Alvaro ..... 52/742.14
6,698,150 B1 3/2004 DiLorenzo
6,721,684 B1 4/2004 Saebi
6,931,806 B2 * 8/2005 Olsen ..... 52/309.11
6,935,081 B2 * 8/2005 Dunn et al. ..... 52/426
6,959,521 B1 * 11/2005 Brooks ..... 52/745.05
7,067,588 B2 * 6/2006 Ritter et al. ..... 525/268
7,127,865 B2 * 10/2006 Douglas ..... 52/745.13
7,162,845 B2 * 1/2007 Messiqua ..... 52/404.1
7,185,467 B2 * 3/2007 Marty ..... 52/425
7,337,591 B2 * 3/2008 Molina ..... 53/426
2002/0023401 A1 * 2/2002 Budge ..... 52/426
2002/0178676 A1 * 12/2002 Yost et al. ..... 52/426
2003/0029107 A1 * 2/2003 Ritter et al. ..... 52/309.11
2003/0097812 A1 * 5/2003 Molina ..... 52/742.1
2003/0168575 A1 * 9/2003 Fearn et al. ..... 249/18
2004/0020160 A1 * 2/2004 Durocher ..... 52/742.1
2005/0086900 A1 * 4/2005 Reynolds ..... 52/745.19
2005/0193678 A1 * 9/2005 Rutledge ..... 52/600

* cited by examiner

LOAD-BEARING SYSTEM FOR FILL MATERIAL STRUCTURE FORMATION

BACKGROUND OF THE INVENTION

Generally, the inventive technology relates to the formation of structures utilizing fill materials capable of hardening, such as concrete. Specifically, the inventive technology involves methods and apparatus for the formation of such structures utilizing enhanced load-bearing capabilities. The inventive technology may be particularly suited to the use of manufacturing and prefabrication processes in construction industry applications.

Modern building techniques may widely employ the use of poured concrete to form structures such as columns, walls, and other building features. One key to successfully using poured concrete in building applications may be to erect a formwork capable of forming the concrete to a desired shape before the concrete has a chance to harden. Conventional formworks may typically rely on panel systems to accomplish this kind of concrete formation. In these kinds of systems, panels may often be placed in parallel orientation to create a space between them into which concrete may be poured. In this manner, poured concrete may be formed within the boundaries of the panels. Further, multiple pairs of panels may frequently be linked together to create a particular shape desired for a given situation. For example, panels may be linked together to form columns, walls, rooms, and other kinds of structures used in building applications. After panels have been linked together in a desired configuration, concrete may be poured into the space between the panels, following which a period of time may be required for the concrete to harden. Once the concrete has hardened, a building structure may be considered to have been formed, and the panels may either be left in place or removed depending on the nature of the application.

However, conventional formworks and the techniques for using them may entail significant drawbacks. For example, conventional formworks may typically be required to be assembled at a job site. This may require performing such assembly in less than ideal conditions and using labor and tools set up at the job site for generalist tasks. Also required may be using building materials delivered to a job site in standardized configurations and adapting them at the job site for the particular needs of the job. For example, if a formwork panel length is not the correct length required for a particular placement, it may be necessary to cut the panel to the required dimensions. Such use of labor on an as-available basis and for on-site customization of materials may be costly and inefficient, requiring time and labor resources that otherwise could be committed elsewhere.

Another drawback may be that conventional formworks may not be able to support external loads before concrete has been poured and has hardened. Once concrete has been poured and has hardened, such a completed concrete structure frequently may be used to support and stabilize other construction elements. Examples of this may include support beams, floor joists, staircases, and the like, any of which may be routinely anchored to a completed concrete structure for support. Indeed, in many applications, a completed concrete structure may serve as a fundamental support for a building structure. However, prior to pouring concrete, it may be that conventional formworks do not possess sufficient strength in and of themselves to provide support for these kinds of construction elements. As a result, it may be necessary to wait until concrete has been poured and hardened, so that the resulting completed concrete structure may be used as a support element. This waiting period may create inefficiencies in the construction process, and sometimes may force the use of alternative methods and devices for support prior to pouring concrete. Moreover, the direct attachment to a conventional formwork of construction elements useful for servicing the formwork itself may be precluded, such as staircases, service platforms, and the like.

A further drawback may be that conventional formworks typically may have minimal ability to support themselves. It may be that conventional formworks often require external bracing to prop up the formwork, such as by kickers or other attached braces. In addition, conventional formworks may often require involved ancillary systems of scaffolding, platforms, ladders, hoists and other similar features to allow construction personnel to service the formworks. Because conventional formworks may typically have minimal ability to support themselves, these ancillary systems frequently may require their own support systems independent of the formwork itself. Moreover, the use of these kinds of external bracing and ancillary systems may create time and cost inefficiencies in the construction process, as they may require time, labor, and material costs both to put into place and remove when no longer needed.

Still a further drawback may be that conventional formworks may present a sub-optimal working environment for construction personnel, and indeed in some cases may pose an actual safety risk to construction personnel. The ancillary systems described above may present cumbersome, cramped, or otherwise difficult working conditions for construction personnel. In multistory applications, it may be particularly difficult for construction personnel working in these conditions to access various levels of the formwork without the benefit of a stair. It may even be that such working conditions may create hazards—such as unsteady ladders, unstable scaffolding, and uneven weight distributions—that may be a significant source of jobsite injury. Such conditions may hinder the efficiency of the workforce on a job site, and may result in increased costs associated with higher incidences of job site injury.

Yet another drawback to conventional formworks may lie in the need to coordinate use of the formwork with various other trades that typically may be required at a job site. The need to coordinate concrete placement with trades such as electrical, mechanical, and plumbing may create an additional layer of time and cost requirements in a construction process. Moreover, if coordination among trades is done poorly, scheduling delays may create increased cost and time inefficiencies. In addition, improper coordination of trades may result in a completed building component having poor workmanship qualities that may require additional time and costs to remedy. In some cases, this may even result in further costs associated with legal actions to determine accountability and compensation required due to substandard workmanship.

This problem may be particularly acute at junctions in the construction process where several trades must come together in order to complete a building component, such as at a service core. Service cores may be components of buildings used for vertical passage of people, cargo, and electrical or mechanical equipment. Service cores may frequently be found in multistory buildings and may include, for example, stair cores, elevator cores, and mechanical equipment cores. In addition to the particular service function they may provide, service cores may often be used to stabilize a building from lateral loads such as wind and seismic activity and possibly to support vertical loads such as floor joists and other structural support elements. Because service cores are typically a place where several trades come together, the problems associated with coordinating trades may be particularly critical.

The use of conventional formworks in conjunction with the construction of service cores presents further drawbacks. In addition to coordinating concrete placement with traditional trades, service cores may generally require coordination of concrete placement with the functional features of the service core itself. In the case of stair cores, for example, it usually is not until after the core is cast and cured, which may take several days or weeks, that the stairs may be able to be installed. Stairs may further have to be erected within the core a landing at a time. It also may often be that low tolerances of the conventional formwork necessitate considerable time correcting fit-up problems with landings and railings.

The foregoing drawbacks associated with conventional formworks may present additional unforeseen costs that may be difficult to estimate. These costs may include unforeseen rework costs to correct poor workmanship engendered by the difficulties of working with conventional formworks. They may also include costs associated with lower productivity engendered by the difficulties of working with conventional formworks. Also reflected may be critical path delay costs. A critical path may be a set of tasks which, when performed in order, represent the longest time to complete. In construction industry applications, a delay in the critical path may often constitute a delay of the entire project. It may be that the difficulties involved with conventional formworks may increase the likelihood of critical path delays.

The foregoing problems regarding conventional formworks may represent a long-felt need for an effective solution to the same. While implementing elements may have been available, actual attempts to meet this need may have been lacking to some degree. This may have been due to a failure of those having ordinary skill in the art to fully appreciate or understand the nature of the problems and challenges involved. As a result of this lack of understanding, attempts to meet these long-felt needs may have failed to effectively solve one or more of the problems or challenges here identified. These attempts may even have led away from the technical directions taken by the present inventive technology and may even result in the achievements of the present inventive technology being considered to some degree an unexpected result of the approach taken by some in the field.

SUMMARY OF THE INVENTION

The inventive technology relates to the formation of structures utilizing fill materials capable of hardening and may include one or more of the following features: techniques for establishing a fill material formation structure having a load-bearing capacity; techniques for prefabricating a load-bearing fill material formation structure; techniques for improving working conditions relating to a load-bearing fill material formation structure; techniques for facilitating the coordination of multiple trades relating to a load-bearing fill material formation structure; and techniques for preinstalling a building component on a load-bearing fill material formation structure. Naturally, objects of the inventive technology will become apparent from the description and drawings below.

DETAILED DESCRIPTION OF THE PREFERRED EMBODIMENTS

Figure 1:
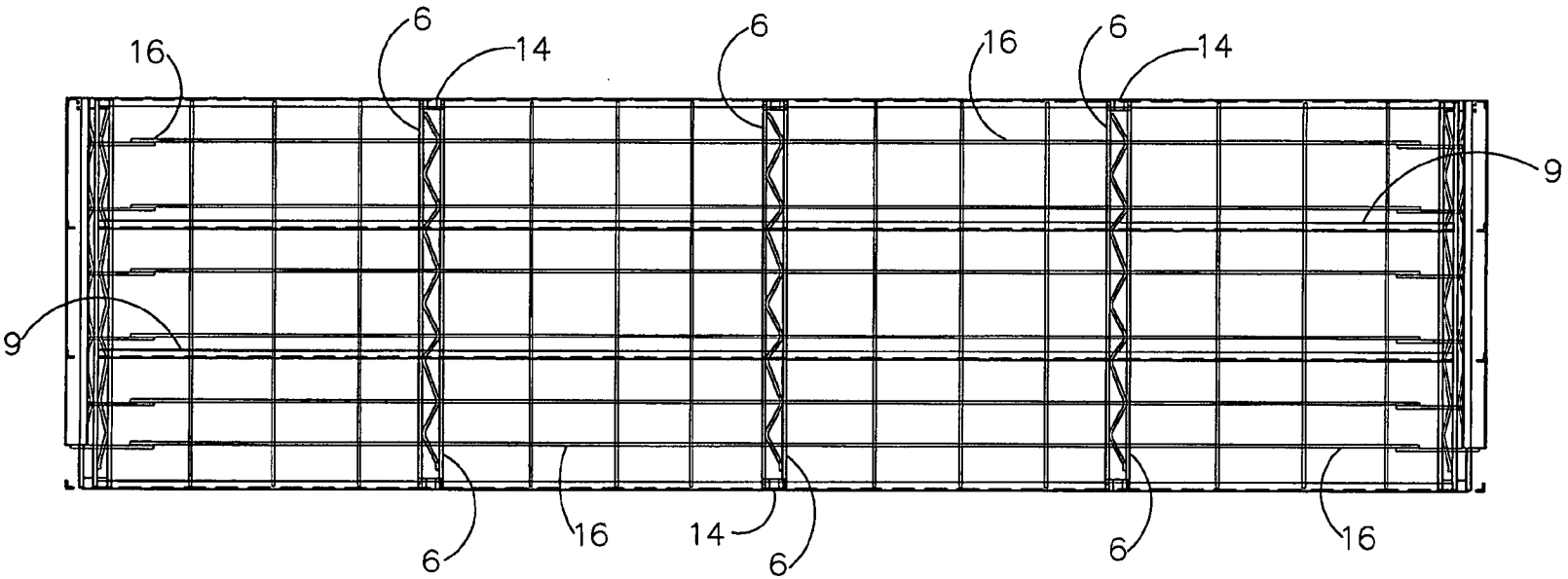
FIG. 1 is an elevation of a load-bearing fill material formation structure showing certain structural elements.
Figure 2:
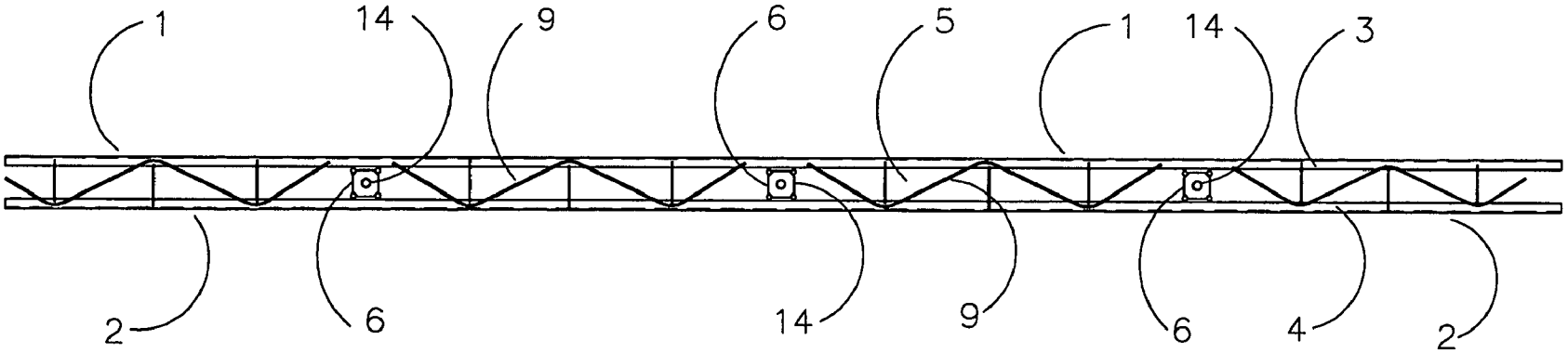
FIG. 2 is a plan view of a load-bearing fill material formation structure showing certain structural elements.
Figure 3:
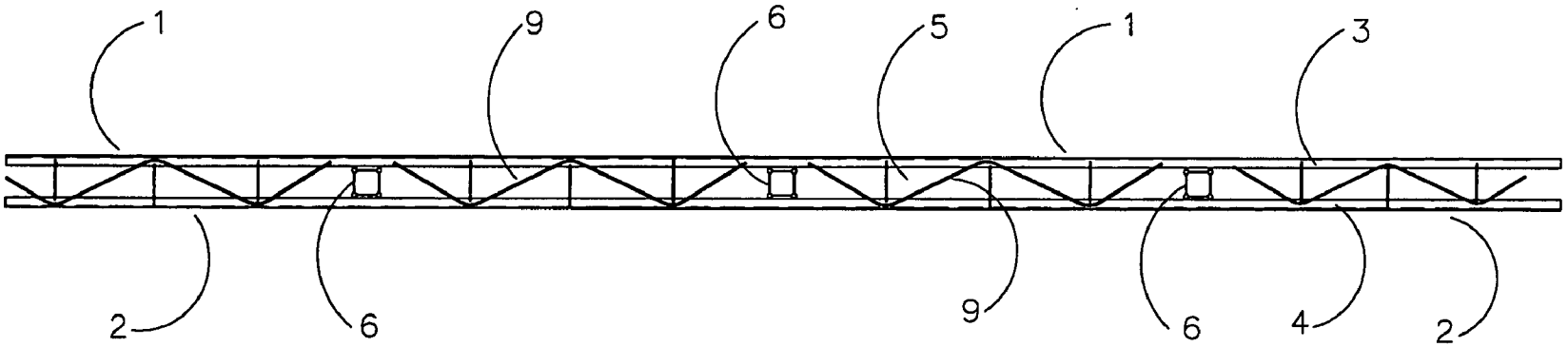
FIG. 3 is a sectional plan view of a load-bearing fill material formation structure showing certain structural elements.
Figure 4:
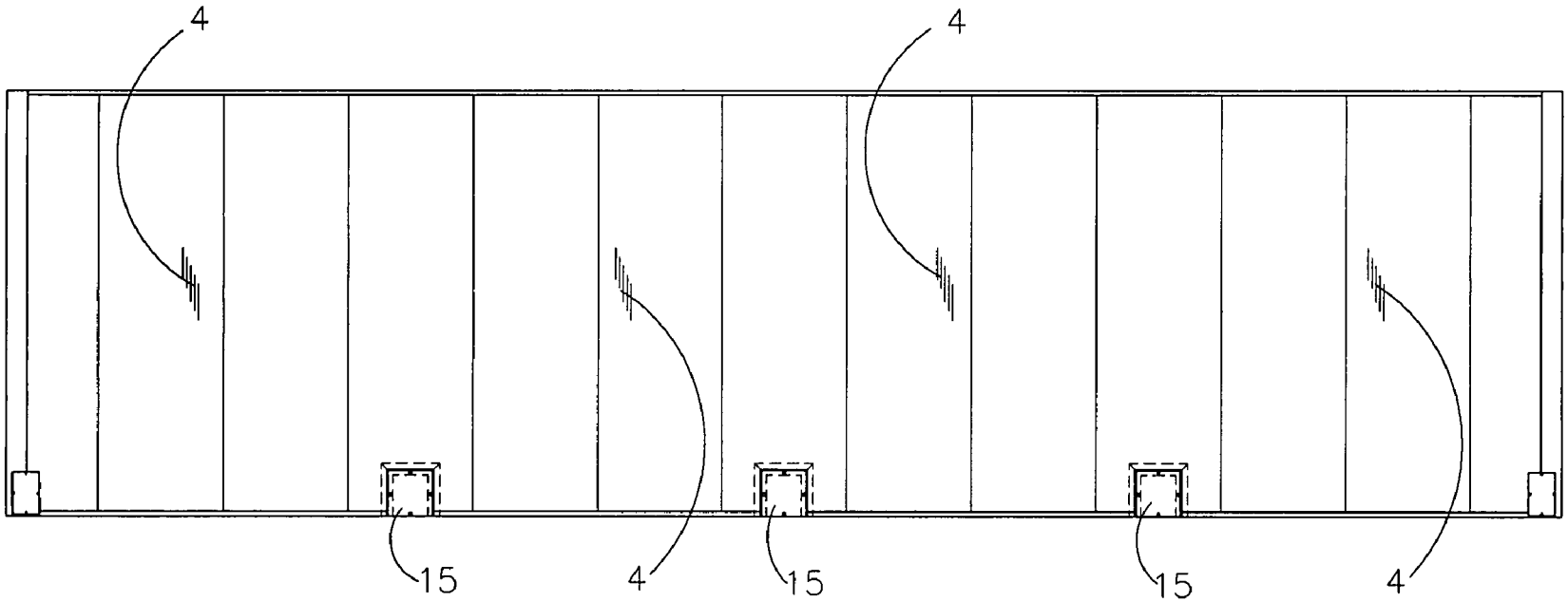
FIG. 4 is an elevation of a load-bearing fill material formation structure showing certain fill material form elements.

The present inventive technology includes a variety of aspects, which may be combined in different ways. The following descriptions are provided to list elements and describe some of the embodiments of the present inventive technology. These elements are listed with initial embodiments, however it should be understood that they may be combined in any manner and in any number to create additional embodiments. The variously described examples and preferred embodiments should not be construed to limit the present inventive technology to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Referring now primarily to FIGS. 1-4, certain embodiments of the inventive technology may involve creating a load-bearing fill material formation structure. Such a load-bearing fill material formation structure may comprise a first boundary location (1) and a second boundary location (2). A boundary location may be a location defining a boundary between two different substances. For example, a fill material may perhaps exist on one side of the boundary and perhaps not exist on the other side of the boundary. Said first boundary location (1) and said second boundary location (2) may be arranged in substantially opposed relation. Such a substantially opposed relation may include said boundary locations arranged so as to be opposite to one another, and indeed may perhaps be equidistant from one another. Accordingly, two boundary locations arranged in substantially opposed relation may be considered to be two substantially opposing boundaries. Additionally, said boundary locations may be in the form of various configurations. Examples of such configurations may include equidistant flat planes, equidistant curved planes, and concentric spherical surfaces or portions thereof. It further may be appreciated that the foregoing merely provide examples of how said first boundary location (1) and said second boundary location (2) may be arranged, and indeed that a suitable configuration for such boundary locations readily may be selected in any given instance by one skilled in the art to satisfy a given requirement.

In some embodiments, a first fill material form element (3) may be situated at said first boundary location (1) and a second fill material form element (4) may be situated at said second boundary location (2). A fill material form element may be an object capable of forming a fill material into a shape defined at least in part by the physical definition of the object. For example, in some embodiments a fill material form element may be a panel or perhaps even a flexible tarp. It may readily be appreciated by those skilled in the art that the dimensions of such a fill material form element may readily be varied depending on the specific application for which the panel may be used. It may also be appreciated that a fill material form element may be shaped to match the definition of the boundary location.

The arrangement of said boundary locations and situation of said fill material form elements may in some embodiments define a void (5) between said first fill material form element (3) and said second fill material form element (4). Such a void (5) may be a space into which a fill material may be poured. A fill material may be a substantially fluid substance capable of hardening into a hardened form. For example, a fill material in some embodiments may be a liquid, a foam, or perhaps even concrete. It may be that such a fill material poured into a void (5) may be confined by said fill material form elements and may take the shape defined by said boundary locations.

Accordingly, a hardened fill material form may be formed by perhaps configuring the shape of the boundary locations. Such hardened fill material forms may include, for example, walls, rooms, columns, buildings, towers, monuments, or other residential, commercial or industrial structures. In this manner, it may be appreciated that a fill material void (5) may be established to include defining the fill material void (5) between at least two substantially opposing boundaries. Certain embodiments also may include providing a rigid demarcation of a fill material void (5) at at least two substantially opposing boundaries. By the term rigid demarcation, it may be understood to demarcate a boundary location by establishing a substantially rigid structure at the boundary location.

Some embodiments may involve maintaining a separation distance between two or more substantially opposing boundaries. A separation distance may be the distance between two or more substantially opposing boundaries, and maintaining a separation distance may be understood to be preventing such distance from changing. For example, a separation distance may be maintained by joining a tie, brace, or perhaps even a hydrostatic resistance member to a rigid demarcation provided at a boundary location.

Certain embodiments may involve substantially sealing a fill material void (5) in a leakage direction. A leakage direction may be a direction in which a fill material may escape from a fill material void (5) through an unsealed opening. For example, such an escape of a fill material may be due perhaps to the action of gravity or even possibly a hydrostatic pressure generated by the poured fill material itself. By the term substantially sealing, it may be understood that a sufficient amount of unsealed openings may be sealed so as to prevent the escape of an amount of fill material poured into a fill material void (5) that would compromise the integrity of a hardened fill material form as determined by a construction industry standard.

In certain embodiments, a nonforming vertical load-bearing enhancement member may be joined to said fill material form elements. By the term nonforming, it may be understood that such a nonforming vertical load-bearing enhancement member may not form a fill material to a significant degree. For example, in some embodiments, it may be that such a nonforming vertical load-bearing enhancement member does not contribute to forming a fill material to the shape of a boundary location. In other embodiments, it may be that such a nonforming vertical load-bearing enhancement member does not form a fill material at all, except possibly with respect to the physical dimensions of the nonforming vertical load-bearing enhancement member itself.

The term vertical load may be understood to be any load having a vertical component. For example, in some embodiments a vertical load may be any load having a vertical component due to gravity. Moreover, a vertical load-bearing enhancement member may in some embodiments be a member that enhances a load-bearing capacity for vertical loads. In some embodiments, such an enhanced load-bearing capacity may be an ability to bear loads that are not generated by the fill material formation structure itself. Stated differently, in the context of a fill material formation structure, an enhanced load-bearing capacity may be an ability to bear the loads of objects that do not form or contribute to the formation of a fill material. Such loads may be termed as supplemental loads, and frequently may be generated by a building component joined to a fill material formation structure. Examples of such a building component may include a stair assembly, a service platform, a shelf angle, a clip angle, an embed plate, a structural support beam, or a joist. Accordingly, a load-bearing fill material formation structure in some embodiments may be understood to be a fill material formation structure having an enhanced vertical load-bearing capacity due to the presence of a nonforming vertical load-bearing enhancement member, perhaps to support supplemental loads generated by building components that themselves do not form or contribute to the formation of a fill material.

A nonforming vertical load-bearing enhancement member may in some embodiments be joined to a first fill material form element (3) and a second fill material form element (4). In certain embodiments, this may involve being directly joined, as may be the case where such a nonforming vertical load-bearing enhancement member directly contacts said first fill material form element (3) and said second fill material form element (4). In other embodiments, this may involve being indirectly joined, as may be the case where there may be one or more intermediate objects, which may separate the nonforming vertical load-bearing enhancement member and at least one of the fill material form elements, but to which the nonforming vertical load-bearing enhancement member and the fill material form element are in contact with.

In certain embodiments, a nonforming vertical load-bearing enhancement member may be disposed between a first fill material form element (3) and a second fill material form element (4). In other embodiments, a nonforming vertical load-bearing enhancement member may simply be located at a non-boundary location. Such a non-boundary location may be any location, for example within said void (5) or even perhaps outside of said void (5), that is not at either a first boundary location (1) or a second boundary location (2). Still other embodiments may utilize a nonforming vertical load-bearing enhancement member that may comprise a fill material permeable vertical load-bearing enhancement member. Such a fill material permeable vertical load-bearing enhancement member may be understood to be a nonforming vertical load-bearing enhancement member that allows a fill material to freely pass through its structure. For example, a fill material permeable vertical load-bearing enhancement member may possess a mesh-like configuration. In each of the foregoing embodiments, it may be seen how a vertical load-bearing enhancement member functions in a nonforming capacity. Moreover, it also may be appreciated by those skilled in the art that a vertical load-bearing enhancement member may be established in a variety of configurations that achieve a nonforming modality.

Accordingly, certain embodiments may include vertically supporting a supplemental load disposed in contiguous relation to a fill material void (5). A supplemental load disposed in contiguous relation to a fill material void (5) may simply be a supplemental load that is carried through at least a portion of a fill material void (5), which may even include the boundary locations of a fill material void (5). By the term vertically supporting, it may be understood that a vertical component of a supplemental load may be supported. For example, in some embodiments, vertically supporting a supplemental load may include vertically supporting a supplemental load with a nonforming vertical load-bearing enhancement member, vertically supporting a supplemental load from within a fill material void (5), vertically supporting a supplemental load from a non-boundary location, or vertically supporting a supplemental load with a fill material permeable vertical load-bearing enhancement member.

Figure 5:
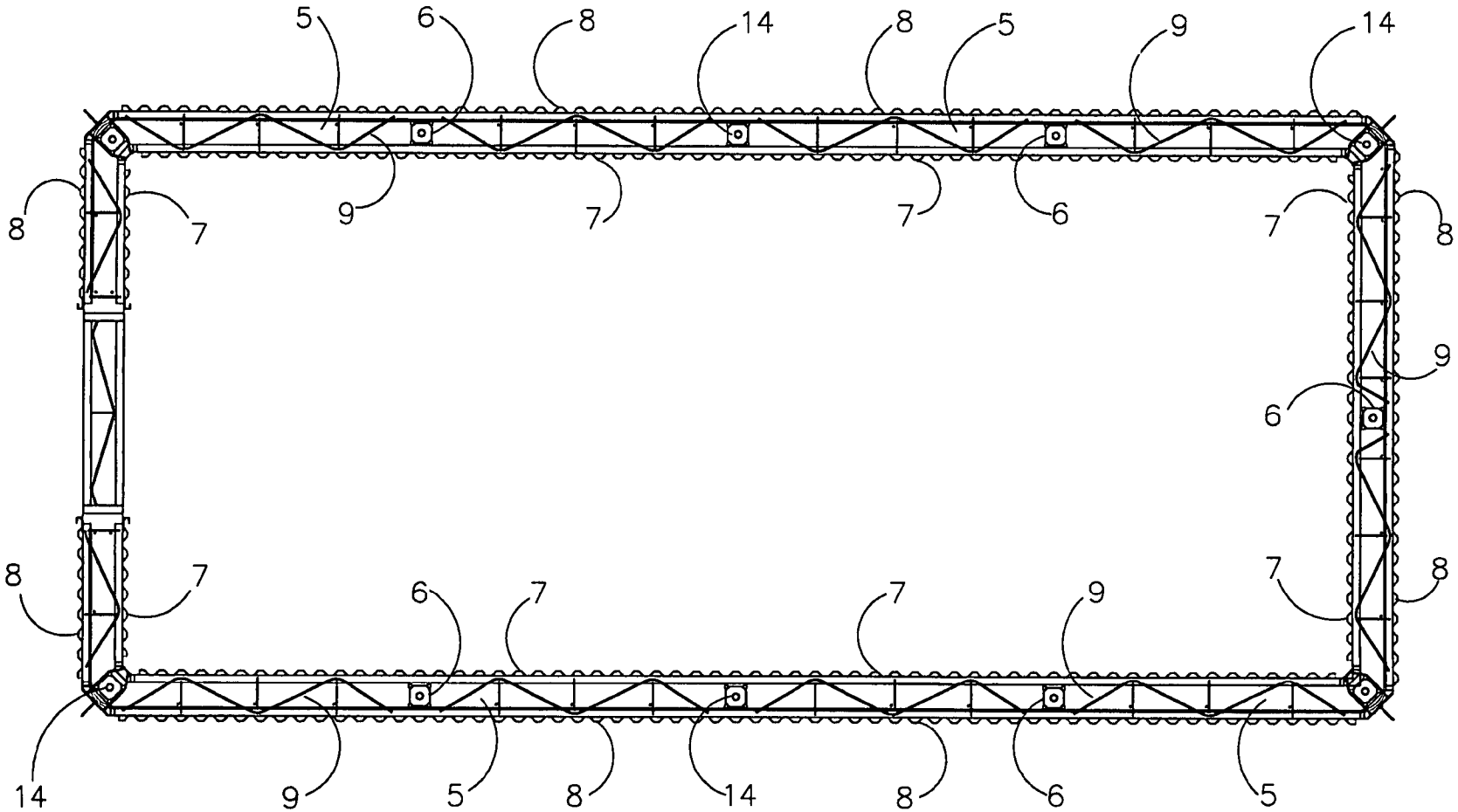
FIG. 5 is a plan view of a service core module showing certain structural elements.

Now referring primarily to FIG. 5, in certain embodiments a plurality of first fill material form elements (7) and second fill material form elements (8) may be joined together to form a service core module. As stated previously, a service core may be a component of a building used for the vertical passage of people, cargo, and electrical or mechanical equipment. A service core module may be considered to be an incremental section of a service core having modular properties allowing it to be joined with at least one other service core module. In this manner, it may be appreciated that two or more service core modules may be joined in stacked vertical relation to form a service core.

In some embodiments, a plurality of first fill material form elements (7) and a plurality of second fill material form elements (8) may be joined together to form a service core module having a substantially enclosed shape. Such a substantially enclosed shape may correspond to, in various embodiments, a circle, a rectangle, or other polygonal shape. By substantially enclosed, it may be understood that a service core module may define a continuously enclosed perimeter with insubstantial interruptions. Such insubstantial interruptions may be, for example, openings for doors, windows, or the like. It may also be that no external bracing may be required for a service core module having a substantially enclosed shape, in as much as such a shape inherently may impart a degree of stability to such a service core module.

Accordingly, certain embodiments may involve incrementally laterally extending a fill material void (5). By incrementally laterally extending, it may be understood that the dimensions of a fill material void (5) may be extended by discrete increments in a lateral direction. In some embodiments, for example, incrementally laterally extending may involve incrementally laterally extending two or more substantially opposing boundaries of a fill material void (5), and may perhaps even include providing a rigid demarcation at each said laterally extended increment. In this manner, it may be appreciated that incrementally laterally extending a fill material void (5) may form a service core module.

Certain embodiments may involve resisting an incrementally progressive expansive force at a boundary location. Such an incrementally progressive expansive force may be, for example, a hydrostatic force generated by pouring a fill material into a fill material void (5). In certain embodiments, a hydrostatic resistance member may be joined to a first fill material form element (3) and a second fill material form element (4). Such a hydrostatic resistance member may resist a hydrostatic force exerted on each fill material form element. For example, in some embodiments, a fill material poured into void (5) may tend to exert a hydrostatic force directed outward against each fill material form element. A hydrostatic resistance member joined to each fill material form element may tend to counter this force, thus maintaining each fill material form in an unchanged position. In certain embodiments, such a hydrostatic resistance member may comprise a hydrostatic resistance truss (9).

In some embodiments, a first fill material form element (3) and a second fill material form element (4) may each comprise a metal plate, or perhaps even a corrugated metal plate. A corrugated metal plate may be a metal plate having a number of folds or ridges. It may be that a corrugated metal plate may provide a higher degree of bending stiffness and may exhibit an increased resistance to hydrostatic forces than a flat metal plate. Accordingly, it may be understood that a corrugated metal plate may be configured to a variety of fold shapes or furrow angles to maximize the bending stiffness or hydrostatic resistance required for a given set of conditions. Moreover, in certain embodiments, providing a rigid demarcation at substantially opposing boundaries may comprise providing a first fill material form element (3) and a second fill material form element (4).

A nonforming vertical load-bearing enhancement member may in certain embodiments comprise a column. A column may be a support element having a length dimension that is greater than a width dimension and configured in a substantially vertical orientation to support a vertical load. In some embodiments, a column may comprise an openly configured support column. An openly configured support column may have the attributes of a column while further being configured to have at least one open space through which a fill material may pass. In further embodiments, an openly configured support column may comprise a lattice column (6). A lattice column (6) may have the attributes of an openly configured support column wherein the volumetric dimensions of the open space through which a fill material may pass may be greater than the volumetric dimensions of the support structure of the column. In this manner, it may be appreciated that a lattice column (6) may possess a degree of vertical load-bearing capacity while also perhaps permitting a substantially uninhibited movement of a fill material through the space in which the lattice column may be located.

Figure 6:
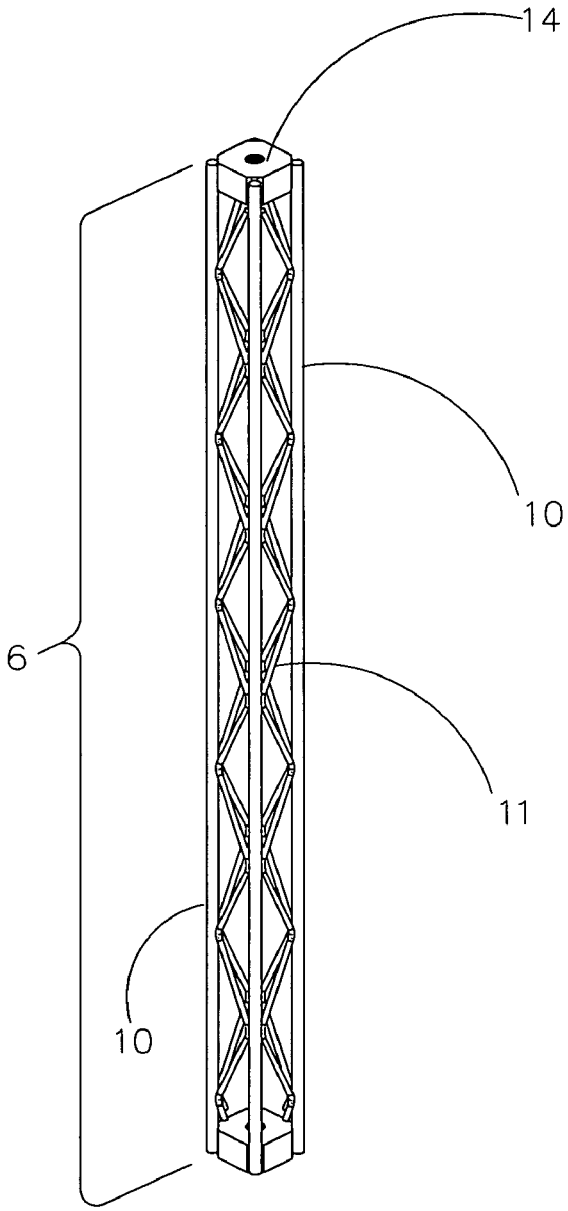
FIG. 6 is an isometric view of a lattice column.
Figure 7:
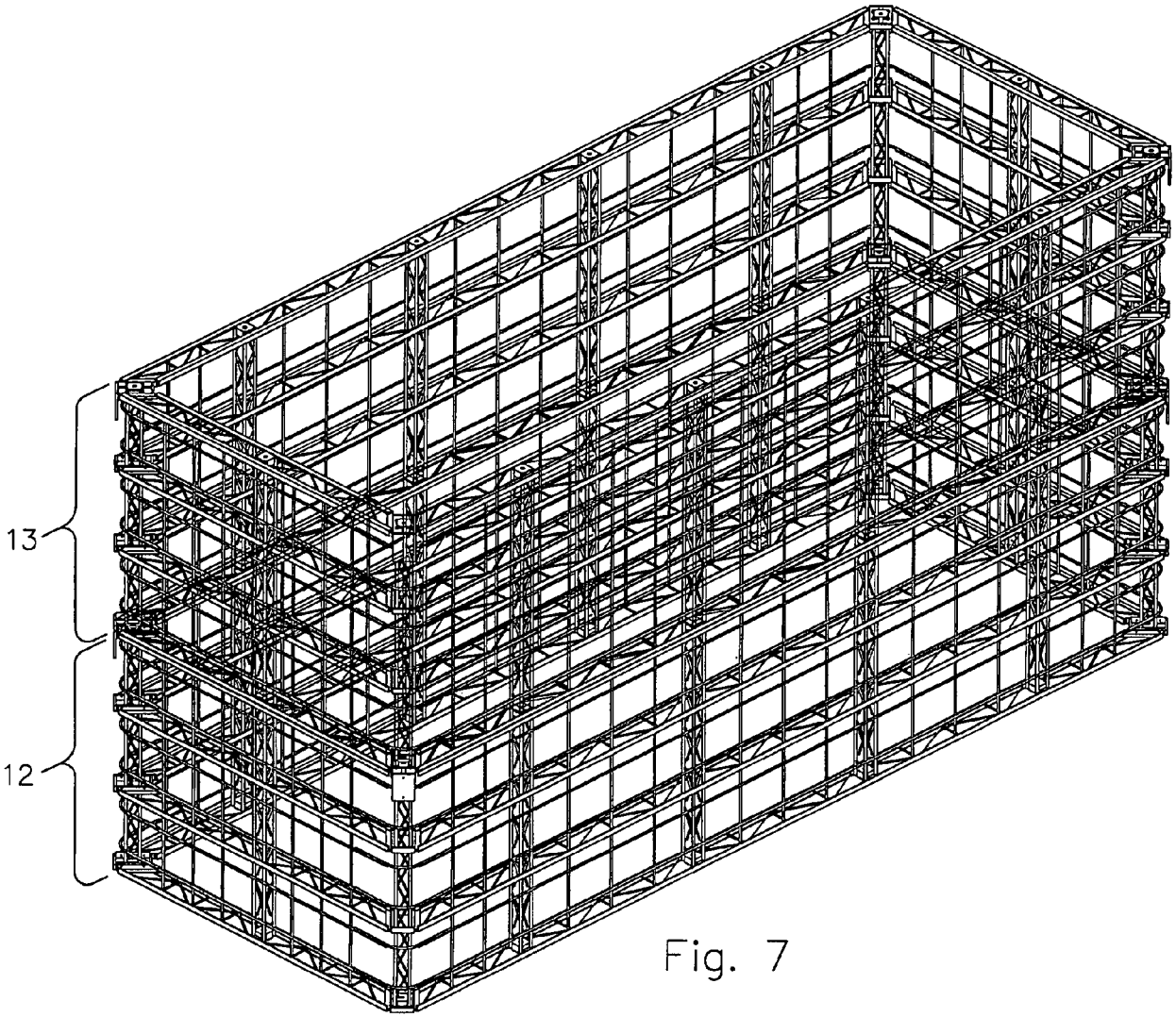
FIG. 7 is an isometric view of two service core modules joined in stacked vertical relation.
Figure 8:
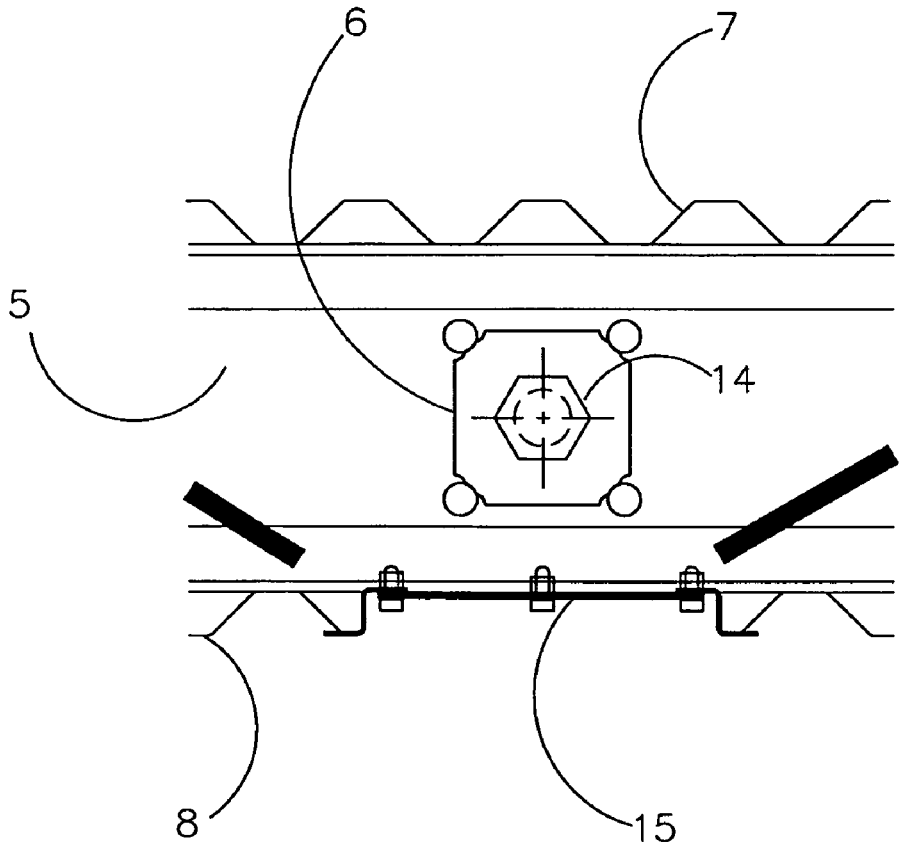
FIG. 8 is a plan view of a vertical assembly connection element disposed within a load-bearing fill material forming structure.
Figure 9:
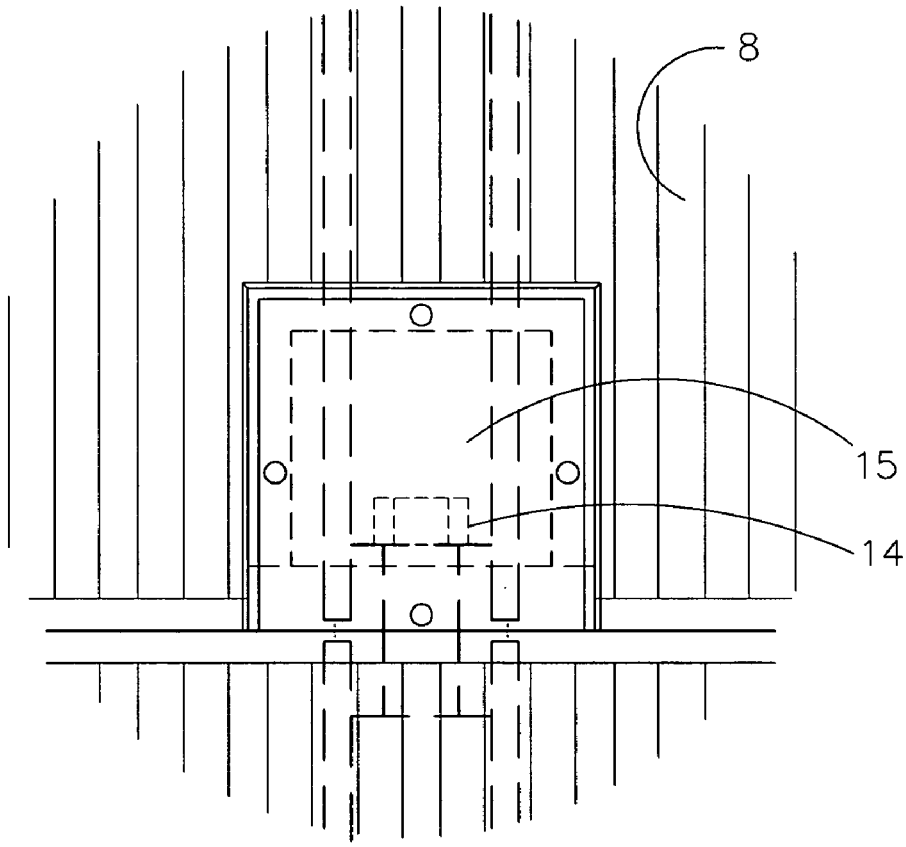
FIG. 9 is an elevation of an access panel.

Now referring primarily to FIG. 6, a lattice column (6) in one embodiment may be illustrated. As may be seen, such a lattice column (6) may comprise four vertically-oriented substantially linear support members (10) that may be arranged to correspond to the four corners of a rectangle. Four vertically-oriented truss support members (11) may be joined to the four vertically-oriented substantially linear support members (10), one each along each side of said rectangle. In some embodiments, the four vertically-oriented substantially linear support members (10) and the four vertically-oriented truss support members (11) may comprise rebar and may be joined by a weld.

Accordingly, in certain embodiments, vertically supporting a supplemental load with a nonforming vertical load-bearing enhancement member may comprise vertically supporting a supplemental load with a column, an openly configured support column, or perhaps even a lattice column (6). Moreover, vertically supporting a supplemental load with a lattice column (6) may include in some embodiments primarily supporting such a supplemental load with four vertically-oriented substantially linear support members (10) and secondarily supporting such a supplemental load with four vertically oriented truss support members (11).

Now referring primarily to FIGS. 7, 8, 9, and 20, a vertical assembly connection element (14) may in some embodiments be joined to a nonforming vertical load-bearing enhancement member. Such a vertical assembly connection element (14) may be an element that permits at least two nonforming vertical load-bearing enhancement members to be connected so that they may be assembled in substantially vertical relation. The term vertical relation may be understood to mean one article located above another article. It may be that a variety of connection modalities are well known within the art that may be suitable to accomplish the connection described. However, in various embodiments, a vertical assembly connection element (14) may be a mechanical fastener, an adhesive, or a weld. In some embodiments, a vertical assembly connection element (14) may comprise a nut and a bolt.

Moreover, a substantially vertical relation into which at least two vertical nonforming load-bearing enhancement members may be assembled may be a stacked vertical relation. It may be appreciated that a stacked vertical relation may comprise being placed substantially one directly over another. Such an arrangement may maximize the load-bearing capacity of the nonforming vertical load-bearing enhancement members by bearing a load along a single vertical axis.

In some embodiments, a load-bearing fill material formation structure may comprise a lower load-bearing fill material formation structure (12) joined in stacked vertical relation to an upper load-bearing fill material formation structure (13). It may be appreciated that said lower load-bearing fill material formation structure (12) and said upper load-bearing fill material formation structure (13) may be substantially identical except with respect to their respective placement in a lower position and an upper position. It may also be that said lower load-bearing fill material formation structure (12) and said upper load-bearing fill material formation structure (13) may be joined by a vertical assembly connection element (14) at a location of two adjoining nonforming vertical load-bearing enhancement members.

Accordingly, certain embodiments may involve incrementally vertically extending a fill material void (5). By incrementally vertically extending, it may be understood that the dimensions of a fill material void (5) may be extended by discrete increments in a vertical direction. In some embodiments, for example, incrementally vertically extending may involve incrementally vertically extending two or more substantially opposing boundaries of a fill material void (5), and may perhaps even include providing a rigid demarcation at each said vertically extended increment. In this manner, it may be appreciated that incrementally vertically extending a fill material void (5) may form a lower load-bearing fill material formation structure (12) joined in stacked vertical relation to an upper load-bearing fill material formation structure (13).

Moreover, in some embodiments, a nonforming vertical load-bearing enhancement member itself also may be incrementally vertically extended. Such incremental vertical extension may be understood to include extending a nonforming vertical load-bearing enhancement member by discrete increments in a vertical direction. For example, in some embodiments, such an incremental vertical extension may be accomplished by joining a lower nonforming vertical load-bearing enhancement member to an upper nonforming vertical load-bearing enhancement member in stacked vertical relation, perhaps by using a vertical assembly connection element (14). In this manner it may be appreciated that incrementally vertically extending a nonforming vertical load-bearing enhancement member may result in a lower load-bearing fill material formation structure (12) and an upper load-bearing fill material formation structure (13) being perhaps joined by a vertical assembly connection element (14) at a location of two adjoining nonforming vertical load-bearing enhancement members.

Accordingly, it may be appreciated that some embodiments may include joining a lower load-bearing fill material formation structure (12) and an upper load-bearing fill material formation structure (13) in vertical stacked relation, and other embodiments may include joining a lower service core module and an upper service core module in vertical stacked relation.

In certain embodiments, an access panel (15) may be disposed on a fill material form element at about a location of a vertical assembly connection element (14). Such an access panel (15) may comprise a panel removably engaged to a fill material form element to cover an opening established on the fill material form element. It may be appreciated that by removing an access panel (15), it may be possible to access a vertical assembly connection element (14) through an opening established on a fill material form element. Conversely, it may be appreciated that when an access panel (15) is engaged to a fill material form element, the opening established on the fill material form element may be substantially sealed so as to prevent the escape of a fill material poured into a void (5) between a first fill material form element (3) and a second fill material form element (4). Accordingly, some embodiments may provide for accessing a vertical assembly connection element (14) from outside of a fill material void (5), perhaps through a rigid demarcation by possibly removing an access panel (15) disposed on a rigid demarcation.

Figure 10:
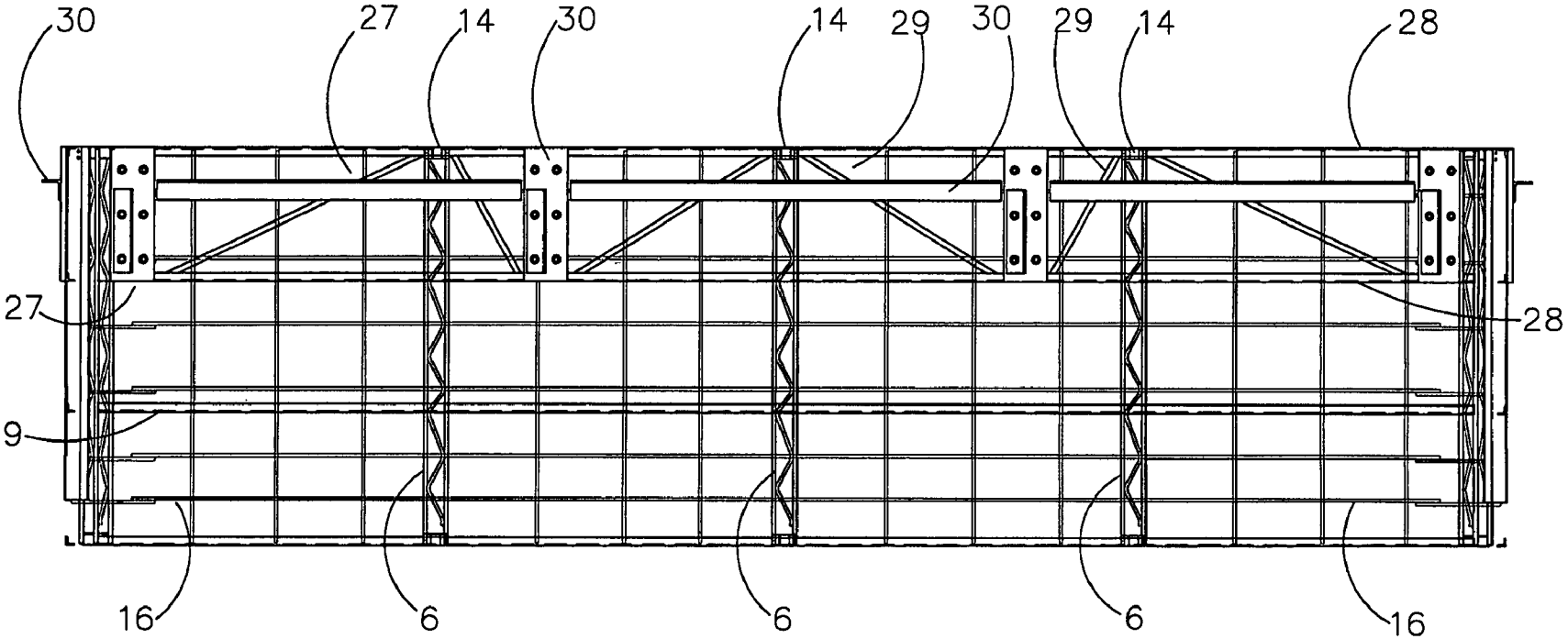
FIG. 10 is an elevation of a service core module showing certain supplemental load transmission elements.
Figure 11:
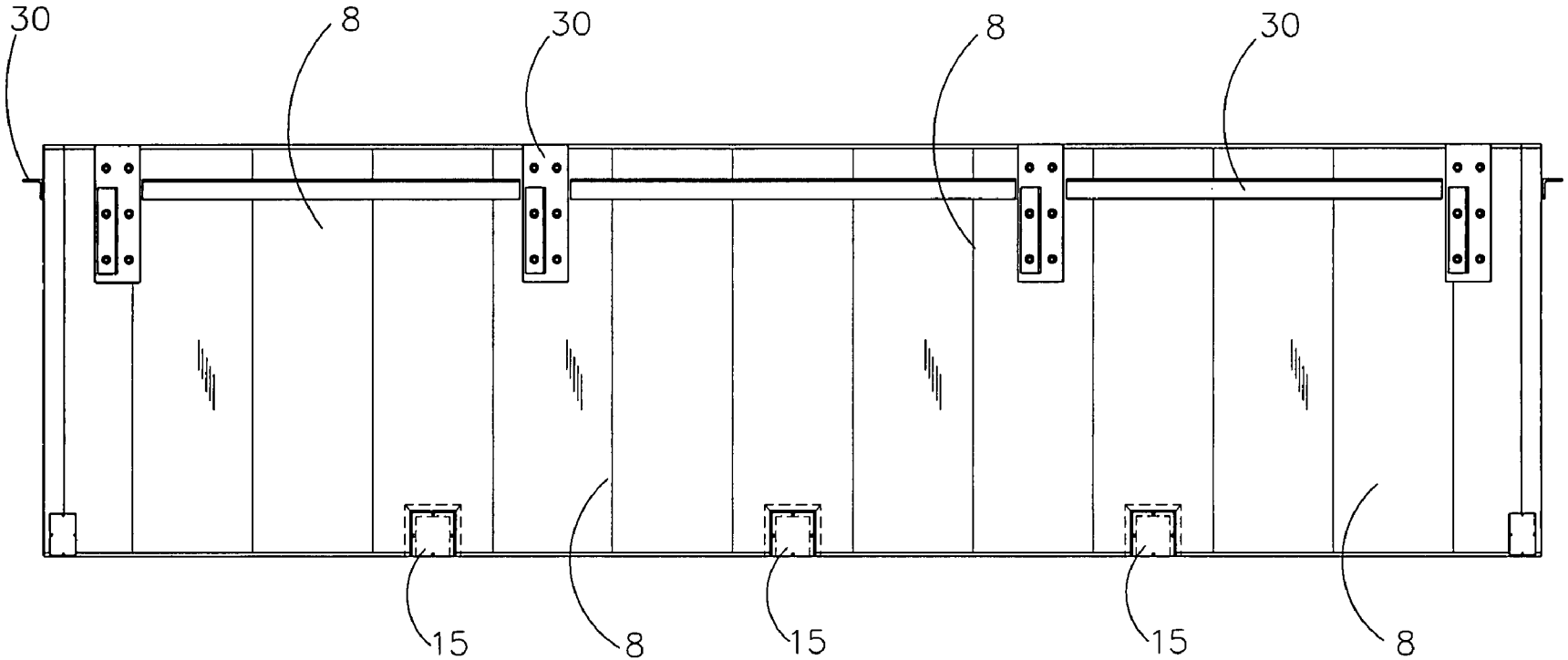
FIG. 11 is an elevation of a service core module showing certain building component elements.
Figure 12:
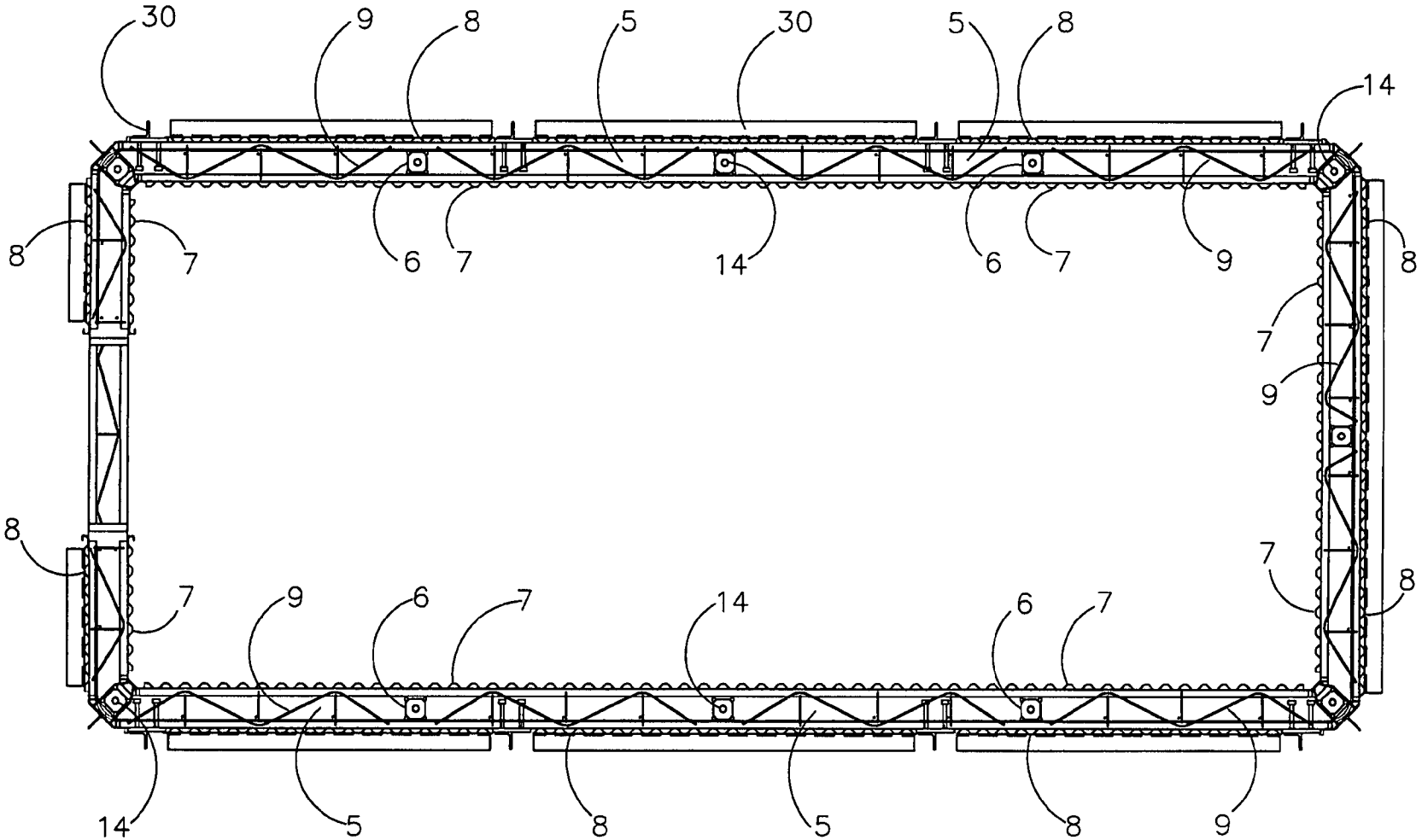
FIG. 12 is a plan view of a service core module showing certain building component elements.

Now referring primarily to FIGS. 10, 11, and 12, in some embodiments a supplemental load transmission system may be joined to a nonforming vertical load-bearing enhancement member. A supplemental load may be a load generated by an object joined to a load-bearing fill material formation structure that itself does not directly contribute to formation of a fill material. Examples of such objects may include building components such as a stair assembly, a service platform, a shelf angle, a clip angle, an embed plate, a structural support beam, or a joist.

In some embodiments, a nonforming vertical load bearing enhancement member may not be able to directly bear a supplemental load. For example, it may be desirable to locate a supplemental load at some distance removed from a nonforming vertical load-bearing enhancement member, perhaps even at a location between two nonforming vertical load-bearing enhancement members. In such a situation, a supplemental load may be considered to be placed at a displaced location. In order for a nonforming vertical load-bearing enhancement member to bear such a supplemental load, it may be necessary to transmit the supplemental load from its displaced location to a nonforming vertical load-bearing enhancement member. Accordingly, a supplemental load transmission system joined to a nonforming vertical load-bearing enhancement member may transmit a supplemental load from a displaced location to a nonforming vertical load-bearing enhancement member.

A supplemental load transmission system in certain embodiments may comprise a displaced load support element. A displaced load support element may be an element capable of supporting a supplemental load at a displaced location. In some embodiments, a displaced load support element may comprise a primary support truss (28) joined to a nonforming vertical load-bearing enhancement member. In other embodiments, a displaced load support element may further comprise a secondary support truss (29) joined to a primary support truss (28). It may be that a primary support truss (28) may act to laterally displace a supplemental load from a nonforming vertical load-bearing enhancement member, and that a secondary support truss (29) may act to vertically displace a supplemental load from a primary support truss (28). In this manner, it may be seen that the combination of a primary support truss (28) and a secondary support truss (29) may be used to locate a displaced load at a number of displaced locations from a nonforming vertical load-bearing enhancement member having a lateral component and a vertical component.

In some embodiments, a supplemental load interface may be joined to a supplemental load transmission system. A supplemental load interface may simply be the modality by which a supplemental load is joined to a supplemental load transmission system. It may be that a variety of modalities are well known within the art that may be suitable to join a supplemental load to a supplemental load transmission system. However, in various embodiments, a supplemental load interface may be a mechanical fastener, an adhesive, or a weld. In particular embodiments, a supplemental load interface may comprise a nut and a bolt.

A building component (30) may in certain embodiments be joined to a supplemental load interface. A building component (30) may be an object joined to a load-bearing fill material formation structure that itself does not directly or indirectly contribute to formation of a fill material. Stated differently, a building component (30) may be an object that confers some functionality to the construction of a building structure, wherein the primary purpose of said functionality is not to form a fill material. In certain embodiments, a building component (30) may comprise a stair assembly, a service platform mount, a shelf angle, a clip angle, an embed plate, a structural support beam, or a joist.

Some embodiments may involve augmenting a structural integrity of a hardened fill material form. By the term augmenting, it may be understood that such a structural integrity may be improved. For example, a supplemental structural reinforcement member may be disposed within a fill material void (5), perhaps between a first fill material form element (3) and a second fill material form element (4). Such a supplemental structural reinforcement member may confer a degree of supplemental structural reinforcement to a hardened fill material form that may be created by pouring a fill material into a void (5). For example, in some embodiments, such a supplemental structural reinforcement member may comprise rebar (16). In other embodiments, a hydrostatic resistance member may be joined to a nonforming vertical load-bearing enhancement member to confer added strength and stability to a load-bearing fill material formation structure.

Figure 13:
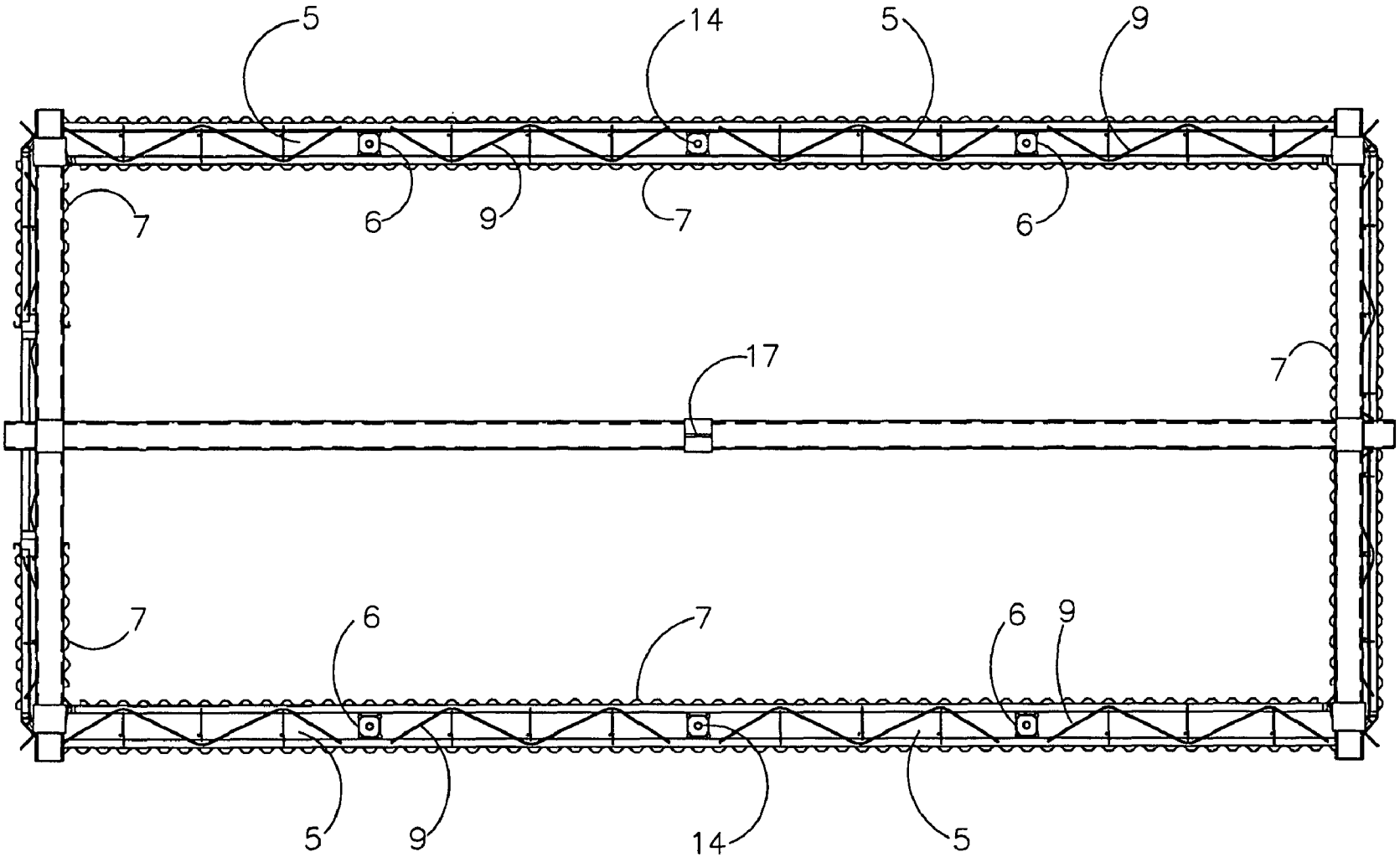
FIG. 13 is a plan view of a service core module showing certain lift elements.
Figure 14:
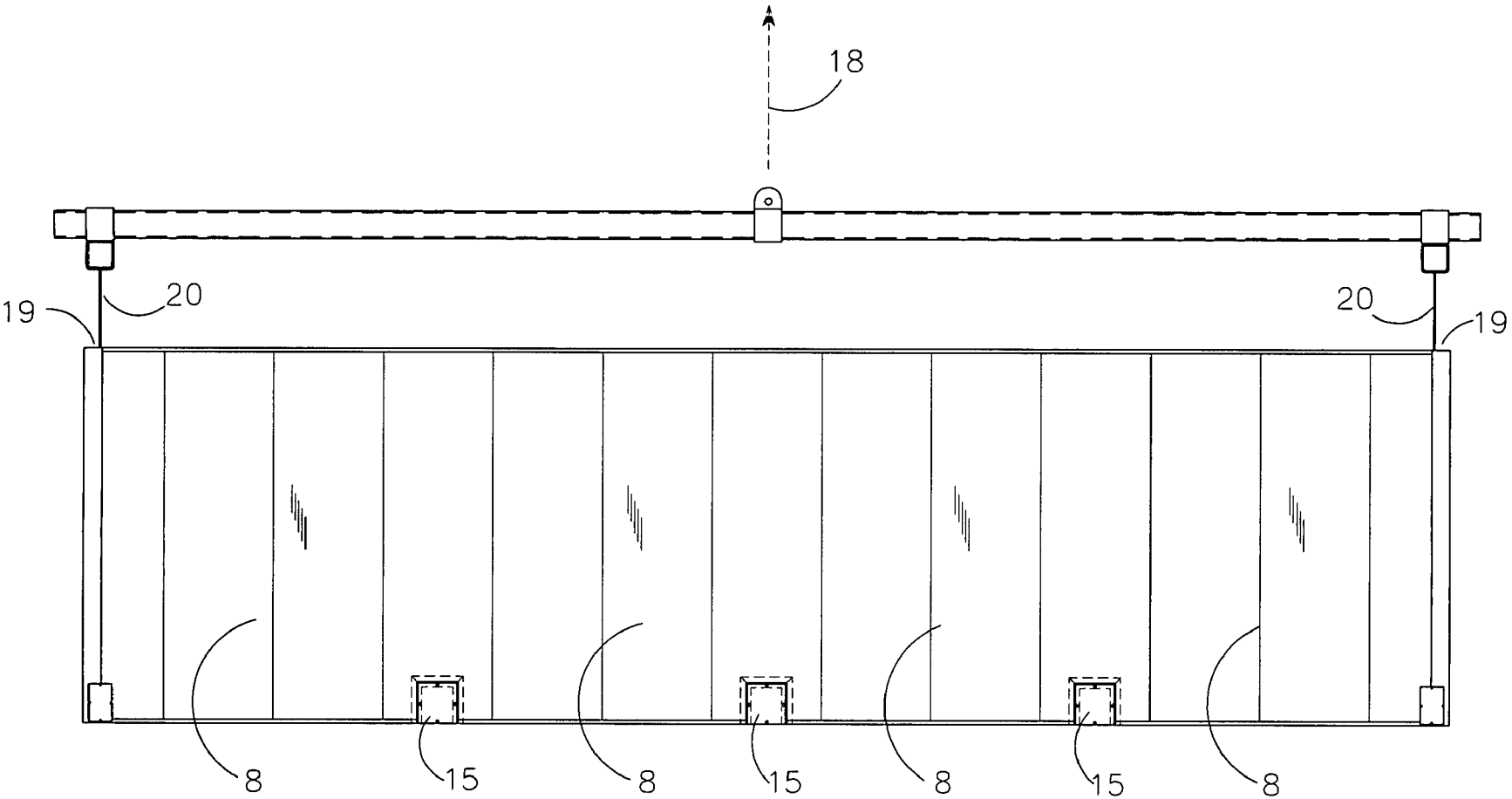
FIG. 14 is an elevation of service core module showing certain lift elements.

Now referring primarily to FIGS. 13-14, a load-bearing fill material formation structure in some embodiments may have a centroid (17). Such a centroid (17) may in some embodiments be a mass centroid or may in other embodiments be an area centroid. A centroid (17) may have an axis of lift (18), which may perhaps be an axis oriented along the direction in which a load-bearing fill material formation structure may be lifted. At least one lift attachment location (19) may be disposed on a load-bearing fill material formation structure so as to be correlated to a lift axis (18) of a centroid (17). The term correlated may be understood to encompass selecting a variable, for example perhaps a lift attachment location (19) or possibly the measurement of a premeasured centroid lift axis correlated lift element, so as to allow a load-bearing fill material formation structure to be lifted in a desired configuration, for example perhaps in a multidimensionally stable orientation.

In some embodiments, a lift element (20) may be attached to a load-bearing fill material formation structure at a lift attachment location (19). A lift element (20) may be an object that, when attached to a load-bearing fill material formation structure, may allow such a load-bearing fill material formation structure to be lifted. While a variety of such objects capable of serving as a lift element (20) may be well known in the art, in some embodiments a lift element (20) may be a rope, wire, cable, chain, or lifting frame. A lift element (20) may further be a premeasured centroid lift axis correlated lift element. A premeasured centroid lift axis correlated lift element may be a lift element (20) that has been measured prior to lifting a load-bearing fill material formation structure to be correlated to a lift axis (18) of a centroid (17).

Accordingly, some embodiments may involve vertically translating a position of a fill material void (5). By vertically translating a position of a fill material void (5), it may be understood that a fill material void (5) may occupy certain dimensions in space, and that the location of a fill material void (5) having such dimensions may be changed in a vertical direction. Moreover, vertically translating such a position may be accomplished in a multidimensionally stable orientation. A multidimensionally stable orientation may be an orientation corresponding to at least two dimensions of a fill material void (5), wherein such dimensions exhibit a substantially fixed orientation. Further, translating a position of a fill material void (5) in a multidimensionally stable orientation may include identifying a centroid (17) of a fill material void (5) and precalculating a multidimensionally stable axis of lift (18). A multidimensionally stable axis of lift (18) may be a lift axis along which a fill material void (5) may be vertically translated in a multidimensionally stable orientation. By the term precalculating, it may be understood that any calculations required to lift a fill material void (5) in a multidimensionally stable orientation may be performed prior to vertically translating a position of a fill material void (5). For example, in some embodiments, a lift element (20) may be premeasured to correspond to a multidimensionally stable axis of lift (18).

Figure 15:
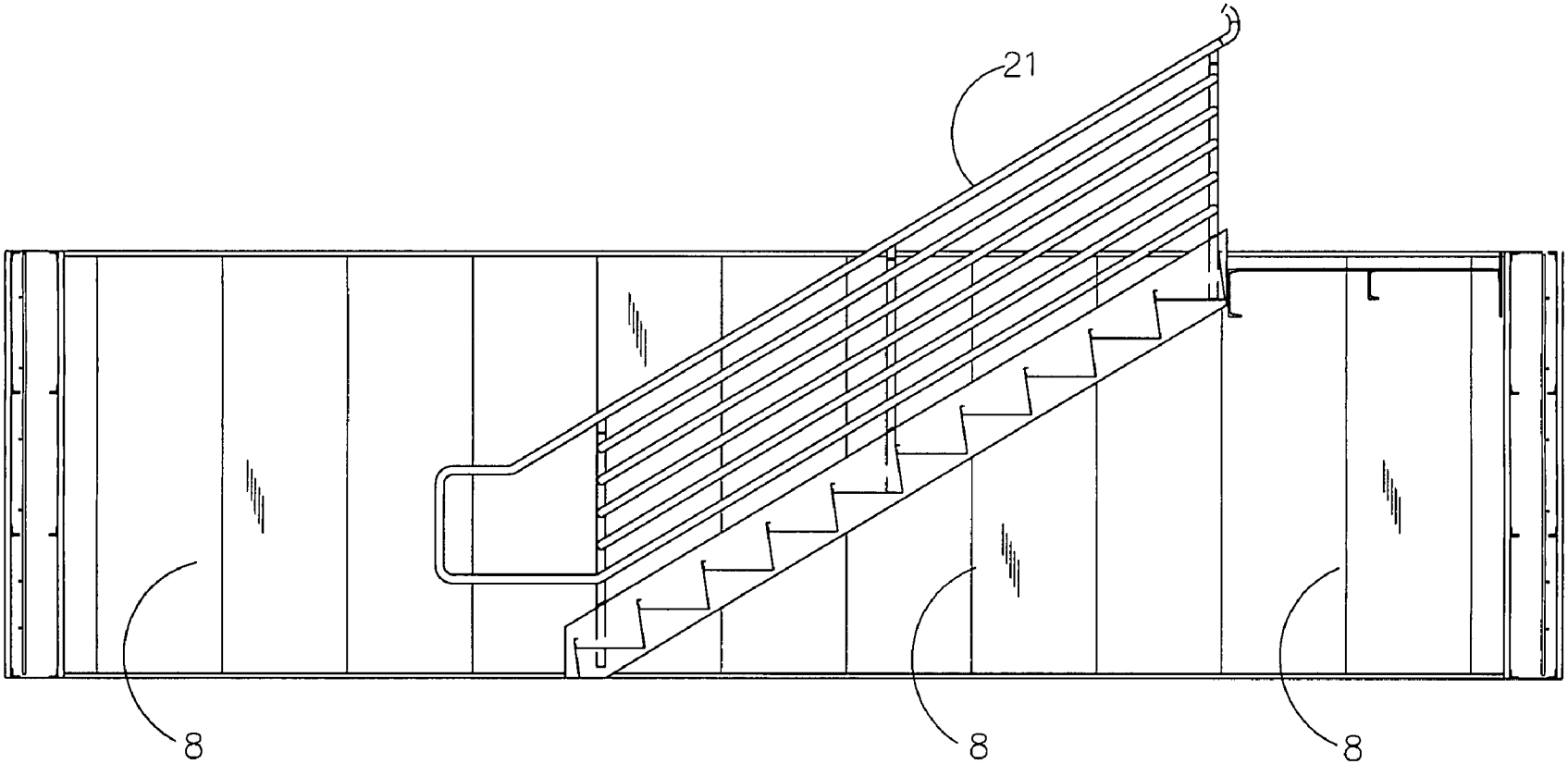
FIG. 15 is a sectional elevation of a service core module showing certain stair assembly elements.
Figure 16:
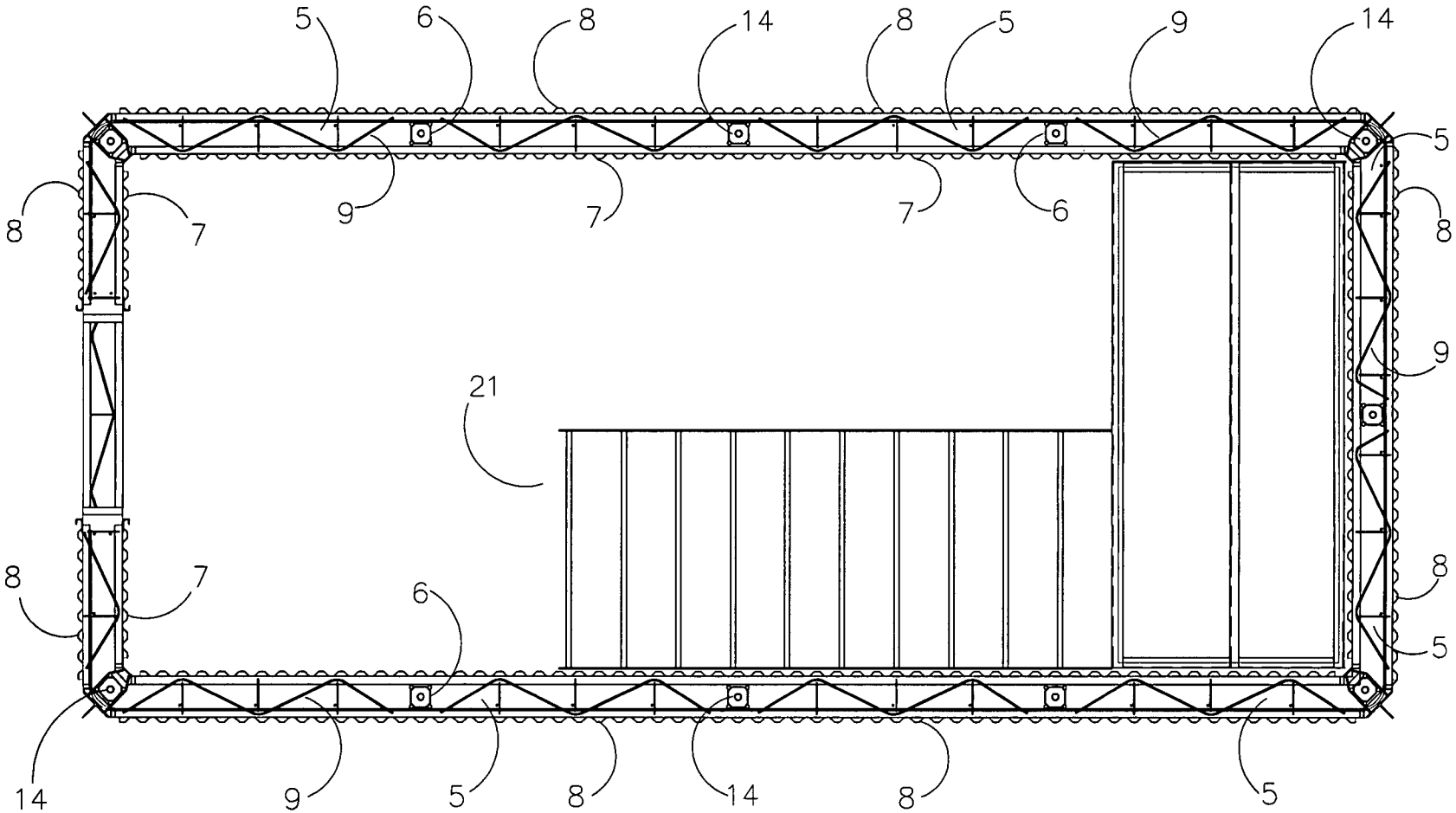
FIG. 16 is a plan view of a service core module showing certain stair assembly elements.
Figure 17:
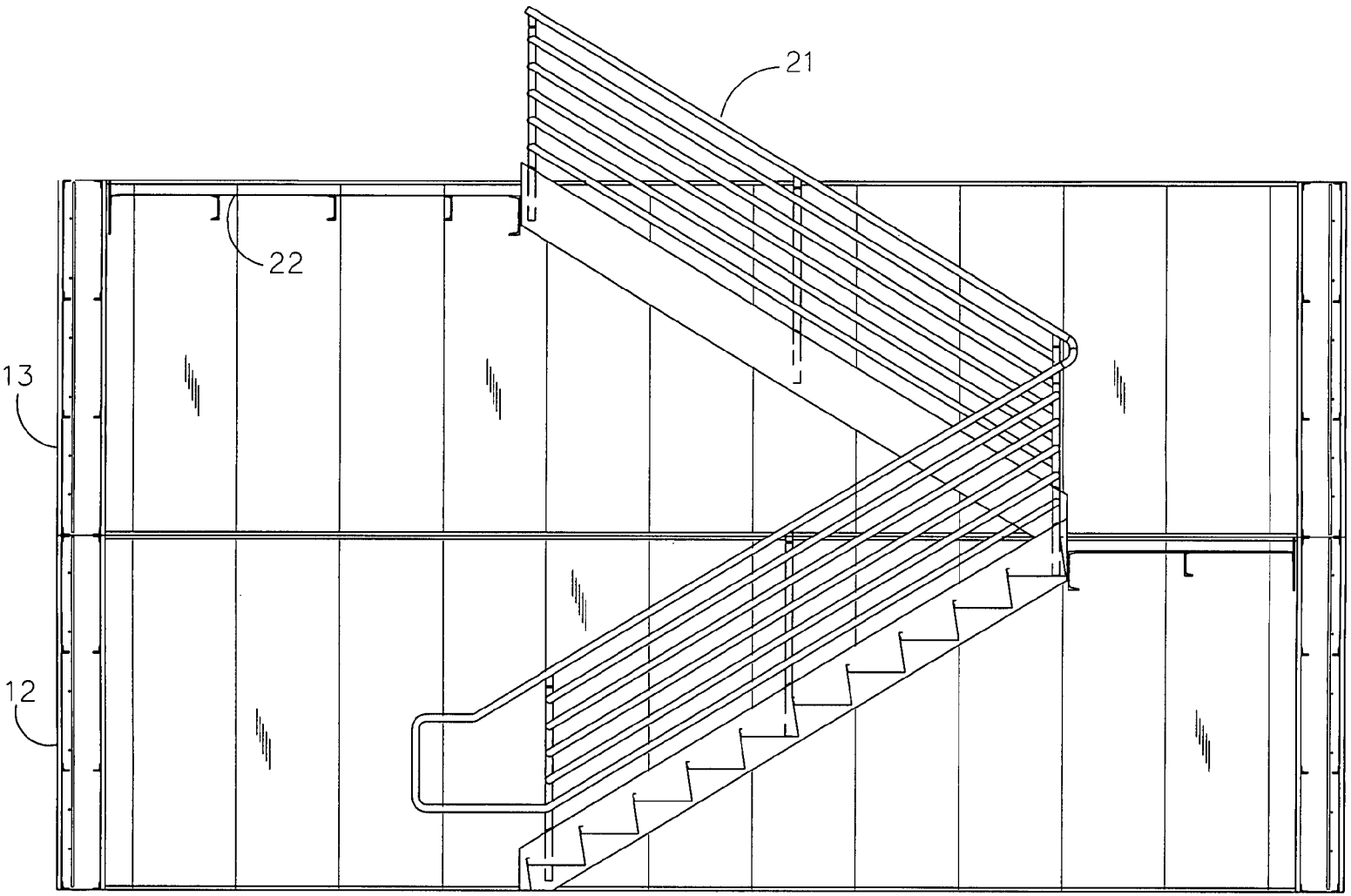
FIG. 17 is a sectional elevation of a continuous stair joined to two service core modules joined in stacked vertical relation.

Now referring primarily to FIGS. 15, 16, and 17, in some embodiments a building component joined to a load-bearing fill material formation structure may comprise a stair assembly (21). Because a stair assembly (21) may be joined to a load-bearing fill material formation structure and may therefore be supported by the same, it may not be required to externally brace such a stair assembly (21). Moreover, a stair assembly (21) in certain embodiments may be a prefabricated stair assembly. A prefabricated stair assembly may be a stair assembly (21) that may be substantially complete prior to being joined to a load-bearing fill material formation structure. In some embodiments, such a prefabricated stair assembly may be a stair assembly (21) that may not be required to be assembled at a job site. Additionally, a stair assembly (21)

in some embodiments may be a preinstalled stair assembly. A preinstalled stair assembly may be a stair assembly that has been joined to a load-bearing fill material formation structure prior to delivery of said load-bearing fill material formation structure to a job site.

Accordingly, some embodiments may involve joining a stair assembly (21) to a supplemental load interface (27), which may include prefabricating a stair assembly (21) and perhaps even preinstalling a stair assembly (21). Moreover, a method of constructing a hardened fill material form may include vertically accessing an elevated location utilizing a stair assembly (21). An elevated location may be a location situated a certain distance above a reference point, and the term vertically accessing may be understood be moving from the reference point to the elevated location. For example, a stair assembly (21) may be utilized to access an elevated location by moving up the stairs from a lower step to an upper step. Examples of an elevated location may be the location of an access panel (15) or a service platform (25).

In some embodiments, a load-bearing fill material formation structure to which a stair assembly (21) may be joined may comprise a lower said load-bearing fill material formation structure (12) joined in stacked vertical relation to an upper said fill material formation structure (13). In such embodiments it may be understood that a stair assembly (21) may be joined to each of said lower load-bearing fill material formation structure (12) and said upper load-bearing fill material formation structure (13). Moreover, it may be appreciated that said stair assembly (21) of said lower load-bearing fill material formation structure may be joined to said stair assembly (21) of said upper load-bearing fill material formation structure to form a continuous stair. A continuous stair may be a staircase having a continuous flight of steps, for example, so as to allow uninterrupted access from one stair assembly (21) joined to another stair assembly (21).

Figure 18:
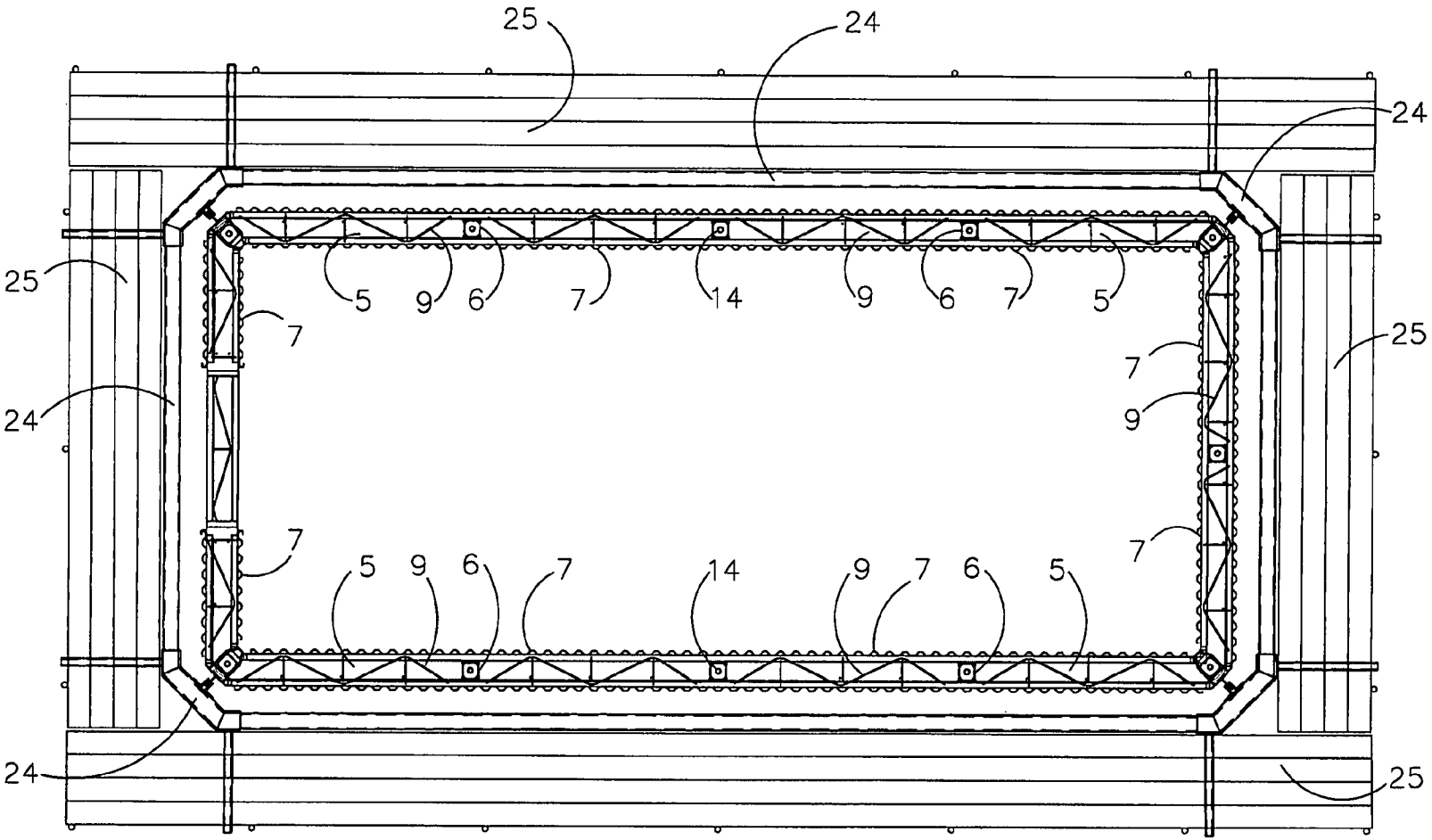
FIG. 18 is a plan view of a service core module showing certain service platform elements.
Figure 19:
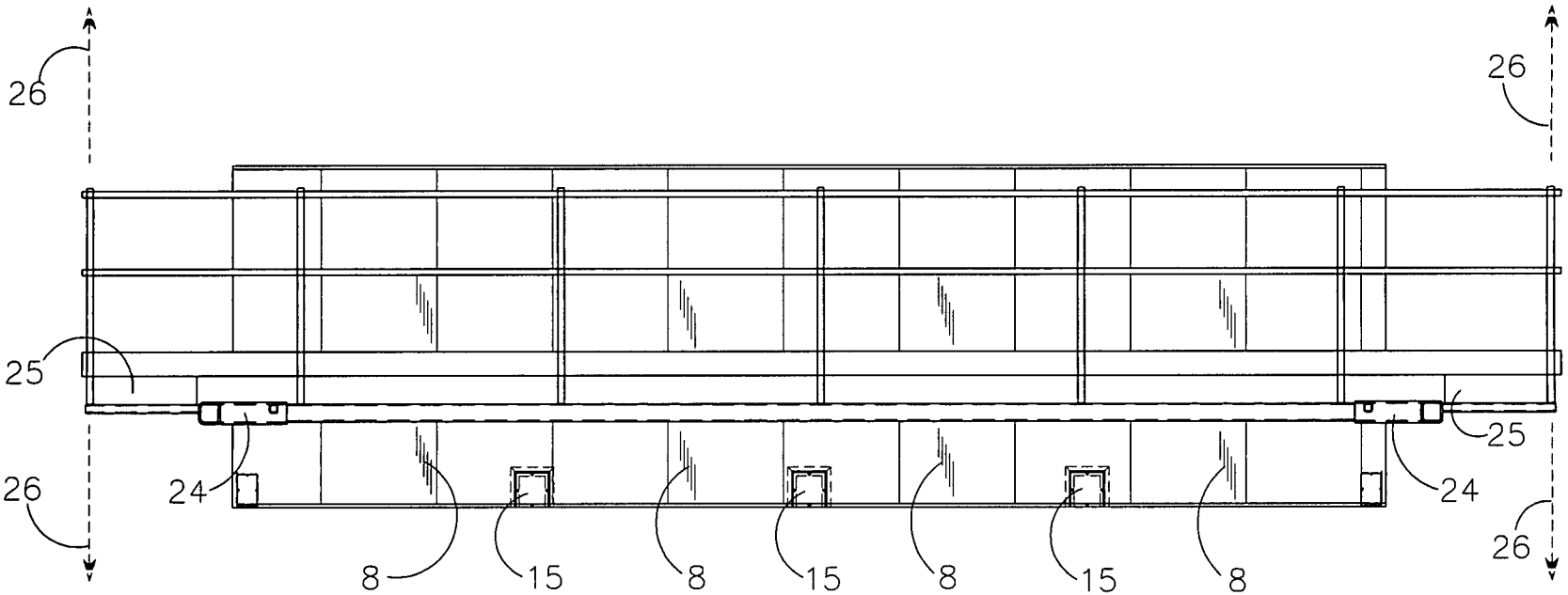
FIG. 19 is an elevation of a service core module showing certain service platform elements.
Figure 20:
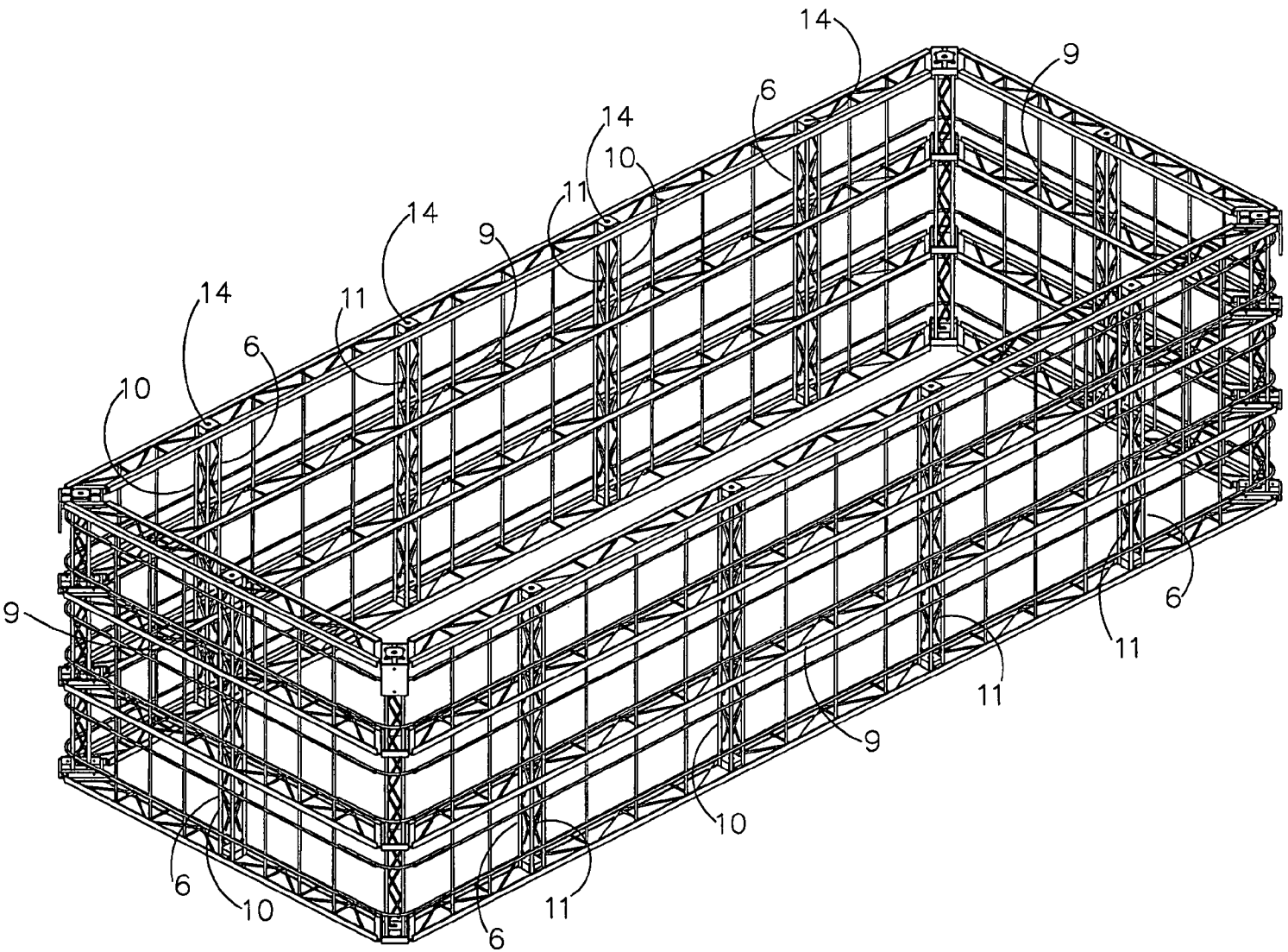
FIG. 20 is an isometric view of a service core module.

Now referring primarily to FIGS. 18-19, in some embodiments a building component joined to a load-bearing fill material formation structure may comprise a service platform mount (24). A service platform (25) may be a platform on which individuals may be able to stand or move about, perhaps in order to service a load-bearing fill material formation structure. Such service of a load-bearing fill material formation structure may include tasks related to assembling, constructing, inspecting, or maintaining a load-bearing fill material formation structure. A service platform mount (24) may be a mount joined to a load-bearing fill material formation structure to which a service platform (25) may be joined and perhaps even supported. In certain embodiments, one or more service platform mounts (24) may be joined to a load-bearing fill material formation structure. Further, one or more service platforms (25) may be joined to and possibly supported by the service platform mounts (24). By appropriately positioning and using an appropriate number of service platform mounts (24), it may be appreciated that a variety of configurations for a service platform may be achieved. For example, a service platform (25) may be positioned on one side of a service core module, may encircle the entire perimeter of a service core module, and may even be positioned at an inside or outside perimeter of a service core module.

In certain embodiments, a service platform mount (24) may be vertically translatable on a load-bearing fill material formation structure. By the term vertically translatable, it may be understood that a position of a service platform mount (24) may be able to be moved in a vertical direction with respect to a load-bearing fill material formation structure to which the service platform mount (24) may be joined. Such vertical translation may be accomplished by a vertical translation element, which may be an element joined to a load-bearing fill material formation structure that permits the vertical translation of a service platform mount (24). For example, in some embodiments, a vertical translation element may be a rail, a pulley, a motor, or a hydraulic lift. Further, it may be appreciated that vertically translating one or more service platform mounts (24) may correspondingly serve to vertically translate a service platform (25) that may be joined to the service platform mounts (24).

Accordingly, some embodiments may involve joining a service platform mount (24) to a supplemental load interface (27), and possibly joining a service platform (25) to a service platform mount (24). Further, certain embodiments may involve vertically translating a service platform mount (24), and perhaps even vertically translating a service platform (25) joined to a service platform mount (24). Moreover, a method of constructing a hardened fill material form may include laterally accessing a horizontal location utilizing a service platform (25), which may perhaps include a service platform (25) that has been vertically translated some distance above the ground. A horizontal location may be a location situated a certain lateral distance away from a reference point, and the term laterally accessing may be understood be moving from the reference point to the horizontal location. For example, a service platform (25) may be utilized to access a horizontal location by moving from one point of a service platform (25) to another. Examples of a horizontal location may include an access panel (15) or perhaps a stair assembly (21).

Additionally, for embodiments in which a lower load-bearing fill material formation structure (12) may be joined in stacked vertical relation to an upper load-bearing fill material formation structure (13), a service platform mount (24) may be vertically translatable from one load-bearing fill material formation structure to another. This may be accomplished by locating individual vertical translation elements on each load-bearing fill material formation structure to be in a vertical alignment. Accordingly, it may be appreciated that a service platform mount (24) and any service platform (25) that may be joined thereto may be vertically translatable along the entire length of any number of load-bearing fill material formation structures that may be joined in stacked vertical relation.

Now referring to FIGS. 1-20, a load-bearing fill material formation structure in some embodiments may be a prefabricated load-bearing fill material formation structure. A prefabricated load-bearing fill material formation structure may be a load-bearing fill material formation structure that may be substantially completed at a remote location from its final installation site. Stated differently, a prefabricated load-bearing fill material formation structure may be a load-bearing fill material formation structure for which no substantial assembly is required at its final installation site. Such a remote location may include, for example, a factory location, a manufacturing location, or an assembly location. Moreover, in certain embodiments, a prefabricated load-bearing fill material formation structure may be a prefabricated service core module. Further, some embodiments may involve delivering a prefabricated load-bearing fill material formation structure to a job site, which may perhaps include delivering a prefabricated service core module to a job site.

Accordingly, in some embodiments the steps of establishing a fill material void, defining a fill material void between at least two substantially opposing boundaries, providing a rigid demarcation of a fill material void at two or more substantially opposing boundaries, maintaining a separation distance between two or more substantially opposing boundaries, substantially sealing a fill material void in a leakage direction, and vertically supporting a supplemental load disposed in contiguous relation to a fill material void, may be accomplished at any of a remote location, a controlled manufacturing environment, to manufacturing tolerances, or to job-specific specifications. A remote location may be a location that is not a final installation site of a load-bearing fill material formation structure, which may for example include a factory location, a manufacturing location, or an assembly location. A controlled manufacturing environment may be an environment in which factors related to manufacturing a load-bearing fill material formation structure may be controlled. Such factors may include for example temperature, humidity, cleanliness, lighting, and workspace. The term manufacturing tolerances may be understood to be permissible deviations from specified values to which a load-bearing fill material formation structure may be constructed that comply with accepted manufacturing standards for a given manufacturing application. Such manufacturing applications may include, for example, welding, cutting, or bolting. The term job-specific specifications may be understood to be specifications to which a load-bearing fill material formation structure may be required to be constructed for a given use. Such specifications may include, for example, size dimensions, shape requirements, or the number of load-bearing fill material formation structures that may required.

In certain embodiments, a prefabricated load-bearing fill material formation structure may comprise preinstalled construction industry trade components. Such construction industry trade components may be components used in construction industry applications that are associated with particular trades. Examples of construction industry trade components may include electrical trade components, mechanical trade components, carpentry trade components, plumbing trade components, or ventilation trade components. Preinstalled construction industry trade components may be construction industry trade components that have been installed on a load-bearing fill material formation structure prior to delivery of said load-bearing fill material formation structure to a job site. Moreover, it may be understood that a prefabricated service core module also may comprise preinstalled construction industry trade components.

Several advantages may attend the inventive technology. One advantage in certain embodiments may be to eliminate the requirement to construct a conventional formwork at a job site, for example by prefabricating a load-bearing fill material formation structure at a remote location. Because such prefabrication may be accomplished in a controlled manufacturing environment or may use manufacturing tolerances or job specific specifications, the need to adjust to field conditions, use generalist labor and tools for specific tasks, and modify standardized parts for specific applications may be avoided. Accordingly, the resources of time, labor, materials, and financial costs may be more efficiently utilized on a job site.

A further advantage in some embodiments may be an ability to join a supplemental load to a load-bearing fill material formation structure prior to pouring and hardening a fill material. This may be because a load-bearing capacity of such a fill material forming structure may confer sufficient strength to allow a supplemental load to be joined without needing to rely on the strength of a completed hardened fill material structure. Accordingly, the joining of building components such as stair assemblies, service platforms, shelf angles, clip angles, embed plates, structural support beams, joists, and the like may be possible and may create resultant efficiencies in a construction process. For example, it may be possible to reduce or perhaps even eliminate delays created by waiting for a fill material to harden, or possibly even reduce or eliminate the need for alternative support methods and devices. Moreover, it may be possible to join building components to a load-bearing fill material forming structure that may be useful in servicing the load-bearing fill material forming structure itself, such as stair assemblies, service platforms, and the like.

Another advantage in certain embodiments may be to minimize or possibly even eliminate the need for external bracing of a load-bearing fill material formation structure. For example, a service core module having a substantially enclosed shape may not itself require external bracing all. Moreover, the need for involved ancillary systems of scaffolding, platforms, ladders, hoists and other similar features to allow construction personnel to service a formwork may be minimized or perhaps eliminated. This may be because construction personnel may be able to provide service by using a stair assembly, service platform, or both. Further, unlike conventional ancillary systems, no independent support may be needed for a stair assembly or service platform joined to a load-bearing fill material formation structure, in as much as support may be provided by the load-bearing capacity of the load-bearing fill material formation structure itself. Accordingly, efficiencies may be realized by reducing or possibly eliminating the time, labor, materials, and financial costs associated with conventional external bracing and ancillary systems.

A further advantage in some embodiments may be to improve upon the frequently suboptimal working conditions associated with conventional formworks. More specifically, embodiments of the inventive technology may reduce or possibly eliminate the causes of such suboptimal conditions, which frequently may be due to the requirement to independently construct and support ancillary systems of scaffolding, platforms, ladders, hoists and other similar features to allow construction personnel to service a formwork. In particular, a service platform joined to and supported by a load-bearing fill material formation structure may permit more freedom of movement that a conventional formwork, where movement may be hindered, for example by ancillary supports, ladders, hoists, or the like. Also, a stair assembly joined to and supported by a load-bearing fill material formation structure may permit easier access to multistory levels, for example perhaps by eliminating the need for ladders, hoists, or the like. Accordingly, improved working conditions may allow for greater efficiency by construction personnel.

Yet another advantage in some embodiments may be to improve safety on a job site. Specifically, the suboptimal conditions associated with conventional formworks may frequently be a cause of job site injuries. By improving upon these suboptimal conditions, for example perhaps by allowing greater freedom of movement along service platforms and stair assemblies and perhaps by providing stable, strong supports for such service platforms and stair assemblies, the risk of injury due to suboptimal conditions may be reduced. Accordingly, increased safety may reduce the costs associated with job site injuries and may even improve morale among construction personnel at a job site.

Still a further advantage in certain embodiments may be to reduce or eliminate problems in coordinating trades at a job site. More particularly, scheduling delays created when one trade falls behind schedule and poor workmanship due to sloppy coordination of overlapping trades may be reduced or eliminated by preinstalling construction industry trade components within a prefabricated load-bearing fill material formation structure. Such preinstalled construction industry trade components may benefit from the use of manufacturing tolerances in a controlled manufacturing environment and may eliminate the field conditions leading to scheduling delays or sloppy workmanship on a job site. Accordingly, efficiencies may be realized by maintaining a construction schedule, reducing remediation costs associated with fixing poor workmanship, and perhaps even by reducing legal costs associated with litigation over scheduling delays and workmanship issues.

Further advantages in some embodiments may be particularly useful in the construction of stair cores. In particular, conventional stair cores may generally require the stairs to be put in place after the concrete is poured. This may typically result in problems—installing stairs one landing at a time, correcting poor fit-up issues, and pouring concrete into metal tread pans—that may be avoided by having a prefabricated, preinstalled stair assembly.

As can be easily understood from the foregoing, the basic concepts of the present invention may be embodied in a variety of ways. It involves both fill material formation techniques as well as devices to accomplish the appropriate formation of fill materials. In this application, the fill material formation techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this patent application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "form" should be understood to encompass disclosure of the act of "forming"—whether explicitly discussed or not—and, conversely, were there effectively disclosure of the act of "forming", such a disclosure should be understood to encompass disclosure of a "form" and even a "means for forming" Such changes and alternative terms are to be understood to be explicitly included in the description.

Any patents, publications, or other references mentioned in this application for patent are hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the formation devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The invention claimed is:

1. A method of constructing a service core hardened fill material form comprising:

establishing a fill material void;

defining said fill material void between at least two substantially opposing boundaries;

providing a rigid demarcation of said fill material void at said substantially opposing boundaries;

maintaining a separation distance between said substantially opposing boundaries;

substantially sealing said fill material void in a leakage direction; and vertically supporting a stair assembly located outside of said fill material void and disposed in contiguous relation to said fill material void through at least one said boundary of said fill material void, with a nonforming vertical load-bearing enhancement member located inside of said fill material void, prior to pouring a fill material into said fill material void.

2. A method of constructing a service core hardened fill material form as described in claim 1, wherein said step of vertically supporting a stair assembly comprises the step of vertically supporting a stair assembly from a non-boundary location.

3. A method of constructing a service core hardened fill material form as described in claim 1, wherein said step of vertically supporting a stair assembly comprises the step of vertically supporting a stair assembly with a fill material permeable vertical load-bearing enhancement member.

4. A method of constructing a service core hardened fill material form as described in claim 1, wherein said steps of establishing, defining, providing, maintaining, sealing, and supporting comprise the step of creating a load-bearing fill material formation structure.

5. A method of constructing a service core hardened fill material form as described in claim 4, further comprising the step of not externally bracing said load-bearing fill material formation structure.

6. A method of constructing a service core hardened fill material form as described in claim 1, further comprising the step of incrementally laterally extending said fill material void.

7. A method of constructing a service core hardened fill material form as described in claim 6, wherein said step of incrementally laterally extending said fill material void comprises the steps of:

incrementally laterally extending said substantially opposing boundaries; and providing a rigid demarcation at each said laterally extended increment.

8. A method of constructing a service core hardened fill material form as described in claim 7, further comprising the step of arranging said substantially opposing boundaries to form a service core module.

9. A method of constructing a service core hardened fill material form as described in claim 8, wherein said step of vertically supporting a stair assembly comprises the step of vertically supporting a stair assembly with a lattice column.

10. A method of constructing a service core hardened fill material form as described in claim 8, further comprising the step of incrementally vertically extending said fill material void.

11. A method of constructing a service core hardened fill material form as described in claim 8, further comprising the step of joining a lower said service core module and an upper said service core module in vertical stacked relation.

12. A method of constructing a service core hardened fill material form as described in claim 9, further comprising the steps of:

transmitting a supplemental load of said stair assembly from a displaced location to said lattice column with a supplemental load transmission system; and joining a supplemental load interface to said supplemental load transmission system.

13. A method of constructing a service core hardened fill material form as described in claim 12, further comprising joining a building component to said supplemental load interface.

14. A method of constructing a service core hardened fill material form as described in claim 13, wherein said building component comprises a building component selected from the group consisting of a shelf angle, a clip angle, and embed plate, a structural support beam, and a joist.

15. A method of constructing a service core hardened fill material form as described in claim 13, wherein said building component comprises a service platform mount.

16. A method of constructing a service core hardened fill material form as described in claim 8, wherein said steps of establishing, defining, providing, maintaining, sealing, and supporting are accomplished at a remote location.

17. A method of constructing a service core hardened fill material form as described in claim 8, further comprising the step of not externally bracing said service core module.

18. A method of constructing a service core hardened fill material form as described in claim 1, wherein said step of providing a rigid demarcation comprises the step of providing a fill material form element at said substantially opposing boundaries.

19. A method of constructing a service core hardened fill material form as described in claim 18, wherein said step of providing a fill material form element comprises the step of providing a metal plate at said substantially opposing boundaries.

20. A method of constructing a service core hardened fill material form as described in claim 19, wherein said step of providing a metal plate comprises the step of providing a corrugated metal plate at said substantially opposing boundaries.

21. A method of constructing a service core hardened fill material form as described in claim 1, wherein said step of vertically supporting a stair assembly with a nonforming vertical load-bearing enhancement member comprises the step of vertically supporting a stair assembly with a column.

22. A method of constructing a service core hardened fill material form as described in claim 21, wherein said step of vertically supporting a stair assembly with a column comprises the step of vertically supporting a stair assembly with an openly configured support column.

23. A method of constructing a service core hardened fill material form as described in claim 22, wherein said step of vertically supporting a stair assembly with an openly configured support column comprises the step of vertically supporting a stair assembly with a lattice column.

24. A method of constructing a service core hardened fill material form as described in claim 23, wherein said step of vertically supporting a stair assembly with a lattice column comprises the steps of:

primarily supporting said stair assembly with four vertically-oriented substantially linear support members arranged to correspond to the four corners of a rectangle; and secondarily supporting said stair assembly with four vertically-oriented truss support members joined to said four vertically-oriented substantially linear support members one each along each side of said rectangle.

25. A method of constructing a service core hardened fill material form as described in claim 1, further comprising the step of joining a vertical assembly connection element to said nonforming vertical load-bearing enhancement member.

26. A method of constructing a service core hardened fill material form as described in claim 25, further comprising the step of incrementally vertically extending said fill material void.

27. A method of constructing a service core hardened fill material form as described in claim 26, wherein said step of incrementally vertically extending comprises the steps of:

incrementally vertically extending said substantially opposing boundaries; and providing a rigid demarcation at each said vertically extended increment.

28. A method of constructing a service core hardened fill material form as described in claim 27, wherein said step of incrementally vertically extending further comprises the step of incrementally vertically extending said nonforming vertical load-bearing enhancement member.

29. A method of constructing a service core hardened fill material form as described in claim 28, wherein said step of incrementally vertically extending said nonforming vertical load-bearing enhancement member comprises the step of joining together a lower said nonforming vertical load-bearing enhancement member and an upper said nonforming vertical load-bearing enhancement member in stacked vertical relation.

30. A method of constructing a service core hardened fill material form as described in claim 29, further comprising the step of accessing each said vertical assembly connection element through at least one said rigid demarcation from outside said fill material void.

31. A method of constructing a service core hardened fill material form as described in claim 30, wherein said step of accessing comprises the step of removing an access panel disposed on said rigid demarcation.

32. A method of constructing a service core hardened fill material form as described in claim 1, further comprising the step of joining a lower said load-bearing fill material formation structure and an upper said load-bearing fill material formation structure in vertical stacked relation.

33. A method of constructing a service core hardened fill material form as described in claim 1, further comprising the steps of:

transmitting a supplemental load of said stair assembly from a displaced location to said nonforming vertical load-bearing enhancement member with a supplemental load transmission system; and joining a supplemental load interface to said supplemental load transmission system.

34. A method of constructing a service core hardened fill material form as described in claim 33, wherein said supplemental load transmission system comprises a displaced load support element.

35. A method of constructing a service core hardened fill material form as described in claim 34, wherein said displaced load support element comprises:

a primary support truss joined to said nonforming vertical load-bearing enhancement member; and a secondary support truss joined to said primary support truss.

36. A method of constructing a service core hardened fill material form as described in claim 33, further comprising joining a building component to said supplemental load interface.

37. A method of constructing a service core hardened fill material form as described in claim 36, wherein said building component comprises a building component selected from the group consisting of a shelf angle, a clip angle, and embed plate, a structural support beam, and a joist.

38. A method of constructing a service core hardened fill material form as described in claim 1, further comprising the step of vertically translating a position of said fill material void in a multidimensionally stable orientation.

39. A method of constructing a service core hardened fill material form as described in claim 38, wherein said step of vertically translating a position of said fill material void in a multidimensionally stable orientation comprises the steps of:

identifying a centroid of said fill material void; and precalculating a multidimensionally stable axis of lift of said centroid.

40. A method of constructing a service core hardened fill material form as described in claim 39, further comprising the step of premeasuring a lift element to correspond to said multidimensionally stable axis of lift.

41. A method of constructing a service core hardened fill material form as described in claim 1, wherein said steps of establishing, defining, providing, maintaining, sealing, and supporting are accomplished at a remote location.

42. A method of constructing a service core hardened fill material form as described in claim 1, wherein said steps of establishing, defining, providing, maintaining, sealing, and supporting are accomplished in a controlled manufacturing environment.

43. A method of constructing a service core hardened fill material form as described in claim 1, wherein said steps of establishing, defining, providing, maintaining, sealing, and supporting are accomplished to manufacturing tolerances.

44. A method of constructing a service core hardened fill material form as described in claim 1, wherein said steps of establishing, defining, providing, maintaining, sealing, and supporting are accomplished to job-specific specifications.

45. A method of constructing a service core hardened fill material form as described in claim 4, further comprising the step of delivering a prefabricated load-bearing fill material formation structure to a job site.

46. A method of constructing a service core hardened fill material form as described in claim 45, wherein said prefabricated load-bearing fill material formation structure further comprises preinstalled construction industry trade components.

47. A method of constructing a service core hardened fill material form as described in claim 46, wherein said preinstalled construction industry trade components comprise preinstalled construction industry trade components selected from the group consisting of electrical trade components, mechanical trade components, carpentry trade components, plumbing trade components, or ventilation trade components.

48. A method of constructing a service core hardened fill material form as described in claim 8, further comprising the step of delivering a prefabricated service core module to a job site.

49. A method of constructing a service core hardened fill material form as described in claim 48, wherein said prefabricated service core module further comprises preinstalled construction industry trade components.

50. A method of constructing a service core hardened fill material form as described in claim 49, wherein said preinstalled construction industry trade components comprise preinstalled construction industry trade components selected from the group consisting of electrical trade components, mechanical trade components, carpentry trade components, plumbing trade components, or ventilation trade components.

51. A method of constructing a service core hardened fill material form as described in claim 1, further comprising the step of prefabricating said stair assembly.

52. A method of constructing a service core hardened fill material form as described in claim 1, further comprising the step of preinstalling said stair assembly.

53. A method of constructing a service core hardened fill material form as described in claim 1, further comprising the step of vertically accessing an elevated location utilizing said stair assembly.

54. A method of constructing a service core hardened fill material form as described in claim 53, wherein said elevated location comprises an access panel disposed on said rigid demarcation.

55. A method of constructing a service core hardened fill material form as described in claim 33, further comprising the step of joining a service platform mount to said supplemental load interface.

56. A method of constructing a service core hardened fill material form as described in claim 55, further comprising the step of vertically translating said service platform mount.

57. A method of constructing a service core hardened fill material form as described in claim 55, further comprising the step of joining a service platform to said service platform mount.

58. A method of constructing a service core hardened fill material form as described in claim 57, further comprising the step of vertically translating said service platform.

59. A method of constructing a service core hardened fill material form as described in claim 57, further comprising the step of laterally accessing a horizontal location utilizing said service platform.

60. A method of constructing a service core hardened fill material form as described in claim 59, wherein said horizontal location comprises an access panel disposed on said rigid demarcation.

61. A method of constructing a service core hardened fill material form as described in claim 1, further comprising the step of pouring a fill material into said fill material void.

62. A method of constructing a service core hardened fill material form as described in claim 61, wherein said step of pouring a fill material into said fill material void comprises the step of pouring concrete into said fill material void.

63. A method of constructing a service core hardened fill material form as described in claim 61, further comprising the step of forming said poured fill material into a hardened fill material form.

* * * * *